US005276483A

United States Patent [19]

Hasegawa et al.

[11] Patent Number: 5,276,483

[45] Date of Patent: Jan. 4, 1994

[54] IMAGE FORMING APPARATUS PROVIDED WITH AN ATTRACTION CHARGER CONTROLLED BY ONE OR MORE AMBIENT CONDITIONS

[75] Inventors: Takashi Hasegawa, Matsudo; Atsushi Takeda, Kawasaki; Kenichi Matsumoto, Tokyo, all of Japan

[73] Assignee: Canon Kabushiki Kaisha, Tokyo, Japan

[21] Appl. No.: 829,619

[22] Filed: Jan. 31, 1992

Related U.S. Application Data

[63] Continuation of Ser. No. 433,851, Nov. 8, 1989, abandoned.

[30] Foreign Application Priority Data

Nov. 8, 1988 [JP] Japan ..... 63-281596
Dec. 22, 1988 [JP] Japan ..... 63-322036

[51] Int. Cl.[5] ..... G03G 21/00

[52] U.S. Cl. ..... 355/208; 355/203; 355/207; 355/273

[58] Field of Search ..... 355/204, 203, 205, 207, 355/208, 273, 274; 271/193

[56] References Cited

U.S. PATENT DOCUMENTS 3,584,733 5/1971 Isermann ..... 271/193 X
4,676,627 6/1987 Ohno ..... 355/221
4,912,515 3/1990 Amemiya et al. ..... 355/274

FOREIGN PATENT DOCUMENTS 0276107 7/1988 European Pat. Off. .
0276112 7/1988 European Pat. Off. .
0298506 1/1989 European Pat. Off. .
2027008 6/1970 Fed. Rep. of Germany .
1307117 2/1973 United Kingdom .

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An apparatus for conveying a transfer material to a position where an image is transferred from an image bearing member such an electrophotographic photosensitive member to it. A humidity detecting device is provided in the image forming apparatus. An attracting device for electrostatically attracting the transfer material on the transfer material conveying device. The attracting device is controlled in accordance with an output of the humidity detecting device. By this, the transfer material can be stably attracted on the carrying device irrespective of the humidity change in the apparatus. When the temperature is taken into account in addition to the humidity, a further preferable attraction control is possible.

11 Claims, 18 Drawing Sheets

| AMBIENCE | REPRESENTATIVE | | ATT. CURRENT (μA) | TRANS. CURRENT (μA) | | | |
|---|---|---|---|---|---|---|---|
| | TEMP(°C) | HUMIDITY(%) | | Y | M | C | Bk |
| (1) | 10 | 10 | 40 | 140 | 240 | 340 | 440 |
| (2) | 15 | 30 | 90 | 160 | 240 | 320 | 400 |
| (3) | 20 | 45 | 130 | 180 | 240 | 300 | 360 |
| (4) | 25 | 60 | 160 | 190 | 230 | 270 | 310 |
| (5) | 30 | 70 | 220 | 240 | 260 | 280 | 300 |
| (6) | 35 | 90 | 290 | 290 | 290 | 290 | 290 |

| AMBIENCE | REPRESENTATIVE | | ATT. CURRENT (μA) |
|---|---|---|---|
| | TEMP (°C) | HUMIDITY (%) | |
| (1) | 10 | 10 | 40 |
| (2) | 15 | 30 | 80 |
| (3) | 20 | 45 | 120 |
| (4) | 25 | 60 | 150 |
| (5) | 30 | 70 | 200 |
| (6) | 35 | 90 | 270 |

| AMBIENCE | REPRESENTATIVE | | ATT. CURRENT (μA) | |
|---|---|---|---|---|
| | TEMP(°C) | HUMIDITY (%) | INSIDE (Iad. i) | OUTSIDE (Iad. Q) |
| (1) | 10 | 10 | 65 | -65 |
| (2) | 15 | 30 | 75 | -75 |
| (3) | 20 | 45 | 95 | -95 |
| (4) | 25 | 60 | 105 | -105 |
| (5) | 30 | 70 | 130 | -130 |
| (6) | 35 | 90 | 165 | -165 |

FIG. 10

| AMBIENCE | REPRESENTATIVE | | ATT. CURRENT ( A) | |
|---|---|---|---|---|
| | TEMP(°C) | HUMIDITY (%) | INSIDE (Iad. i) | OUTSIDE (Iad. Q) |
| (1) | 10 | 10 | 35 | -100 |
| (2) | 15 | 30 | 50 | -100 |
| (3) | 20 | 45 | 70 | -100 |
| (4) | 25 | 60 | 110 | -100 |
| (5) | 30 | 70 | 145 | -100 |
| (6) | 35 | 90 | 170 | -100 |

FIG. 12

| AMBIENCE | REPRESENTATIVE | | ATT. CURRENT (μA) | TRANS. CURRENT (μA) | | | |
|---|---|---|---|---|---|---|---|
| | TEMP(°C) | HUMIDITY(%) | | Y | M | C | Bk |
| (1) | 10 | 10 | 40 | 140 | 240 | 340 | 440 |
| (2) | 15 | 30 | 90 | 160 | 240 | 320 | 400 |
| (3) | 20 | 45 | 130 | 180 | 240 | 300 | 360 |
| (4) | 25 | 60 | 160 | 190 | 230 | 270 | 310 |
| (5) | 30 | 70 | 220 | 240 | 260 | 280 | 300 |
| (6) | 35 | 90 | 290 | 290 | 290 | 290 | 290 |

FIG. 16

IMAGE FORMING APPARATUS PROVIDED WITH AN ATTRACTION CHARGER CONTROLLED BY ONE OR MORE AMBIENT CONDITIONS

This application is a continuation of application Ser. No. 07/433,851 filed Nov. 8, 1989 now abandoned.

FIELD OF THE INVENTION AND RELATED ART

The present invention relates generally to an image forming apparatus, more particularly to monochromatic or multi-color image forming apparatus such as electrophotographic copying machine or monochromatic or color printer provided with an image transfer device wherein a transfer material is electrostatically attracted and carried on transfer material carrying means; an electric field is applied to the transfer material to transfer onto the transfer material a visualized image formed with a developer on an image bearing member such as an electrophotographic photosensitive member.

A typical image forming apparatus of this type has a structure shown in FIG. 19, for example. In the image forming apparatus shown in FIG. 19, there is provided a transfer material conveying belt and a photosensitive drum 1. Around the photosensitive drum 1, there are disposed a cleaner 9, a pre-exposure lamp 10, a primary charger 2, a developing device 4, a transfer charger 8 and a transfer material conveying belt 5 stretched around metal rollers 13, 14 and 15 as major components. The structure will be described in detail. The primary charger 2 and the developing device 4 define a clearance therebetween, through which image exposure light 3 is projected onto the outer periphery of the photosensitive drum 1 from image exposure means. The transfer material conveying belt 5 is stretched around the metal rollers 13, 14 and 15 generally in the form of triangle. The metal rollers 13, 14 and 15 are electrically grounded. The transfer material conveying belt 5 is rotatable in the direction indicated by an arrow in FIG. 19 (counterclockwise direction by a driving motor, not shown) operatively coupled with the metal roller 15. Around the transfer material conveying belt 5, there are disposed an attraction charger 6 for attracting the transfer material P which is a member for receiving the image onto the transfer material conveying belt 5, an opposing roller 7, a charge removing discharger 11 and a fur brush cleaner 12.

In the image forming apparatus having the structure described above, the residual developer remaining on the outer peripheral surface of the photosensitive drum 1 is scraped off by the cleaner 9, and the residual electric charge remaining on the outer periphery of the photosensitive drum 1 is removed by the pre-exposure lamp 10. Thereafter, the outer peripheral surface of the photosensitive drum 1 is uniformly charged by the primary charger 2. After the surface of the photosensitive drum 1 is uniformly charged by the primary charger 2, image exposure light 3 is projected onto the photosensitive drum 1 surface, by which an electrostatic latent image is formed corresponding to original image information on the photosensitive drum 1. After the electrostatic latent image is formed on the surface of the photosensitive drum 1, the developing device 4 is operated to visualize the electrostatic latent image. With continued rotation of the photosensitive drum 1 (clockwise direction in FIG. 19), the visualized image is conveyed to an image transfer station where the outer surface of the photosensitive drum 1 and the transfer charger 8 are opposed to each other.

On the other hand, the transfer material P is supplied by an unshown sheet supply system in the direction indicated by an arrow A in FIG. 19. The transfer material P conveyed to the transfer material conveying belt 5 is attracted on the transfer material conveying belt 5 by applying to the attraction charger 6 a high DC voltage or a high DC-biased AC voltage. Into the transfer material P attracted on the transfer material conveying belt 5, the attraction charge is injected by the opposing roller 7 functioning as an opposite electrode of the attraction charger 6, and the transfer material P is press-contacted to the transfer material conveying belt 5 by the roller 7. The transfer material P thus attracted and pre-contacted on the transfer material conveying belt 5 is carried to the above-described station by movement of the transfer material conveying belt 5, and the visualized image formed on the surface of the photosensitive drum 1 is transferred onto the transfer material P by applying to the transfer charger 8 a high voltage having a polarity opposite to that of the charge of the developer forming the visualized image. The transfer material P onto which the visualized image has been transferred by the transfer charger 8 is electrically discharged by the discharger 11 supplied with a high AC voltage. Then, the transfer material P is separated from the transfer material conveying belt 5, and thereafter, it is conveyed in the direction B in FIG. 19 to an image fixing device (not shown) where the image is fixed. The developer remaining on the surface of the photosensitive drum 1 is removed by the cleaner 9, and the residual electric charge remaining on the photosensitive drum 1 is removed by the pre-exposure lamp 10 having sufficient illumination, by which the photosensitive drum 1 is prepared for the next image formation process.

In the conventional color image forming apparatus described above, the level of the high voltage applied to the attraction charger 6 is constant irrespective of whether variation in the ambience conditions under which the image forming apparatus is installed, and therefore, the attraction of the transfer material P to the transfer material conveying belt 5 is performed with the constant voltage. However, when the image forming apparatus is placed under a high temperature and high humidity condition, the volume resistivity of the transfer material P used is lower approximately by two orders than when the image forming apparatus is placed under a normal temperature and humidity condition (temperature of 23° C. and the relative humidity of 60%, for example), in the case of the transfer material P made of paper, as regards the transfer material conveying belt 5, the surface resistance thereof decreases due to the moisture on the surface.

Therefore, the constant voltage level applied to the attraction charger 6 is to low, with the result that the attraction of the transfer material P onto the transfer material conveying belt becomes insufficient. If this occurs, the transfer material P is shifted on the transfer material conveying belt 5, or it may be separated therefrom. On the other hand, when the image forming apparatus is placed under a low temperature and low humidity condition, the volume resistivity of the transfer material P is higher approximately by two orders than when the image forming apparatus is placed under normal temperature and normal humidity condition (23° C.

and 60%), in the case of the transfer material P made of paper. As regards the transfer material conveying belt 5, the amount of moisture absorbed on the surface thereof decreases with the result that the surface resistance of the transfer material conveying belt 5 increases. Therefore, the constant voltage level is enough to provide sufficient attraction force between the transfer material P and the transfer material conveying belt 5.

However, the electric charge deposited on the backside of the transfer material conveying belt 5 and the front surface of the transfer material P by the attraction charging of the attraction charger 6 is not attenuated before the transfer material reaches the transfer station, so that the good image transfer operation is not performed. Generally in the transfer process executed, a surface potential V1 of the transfer material conveying belt 5 before the execution of the image transfer process or operation and a surface potential V2 after the transfer operation are such that $V1<V2$ when the polarity of the transfer charge is positive. It is empirically known that the difference between the voltages, that is, $V2-V1$ is not less than 0.5 KV. When the image forming apparatus is placed under the low temperature and low humidity condition, the voltage applied to the attraction charger 6 is too high, and therefore, there is a tendency that the surface potential V1 of the transfer material conveying belt 5 approaches a saturated potential Vs of the transfer material conveying belt, and therefore, the above-described requirement of $V2-V1>0.5$ KV can not be satisfied with the result of improper image transfer. Such improper image transfer occurs in a full color electrophotographic copying machine provided with the transfer material conveying belt or a transfer drum or the like. In the color copying machine, the visualized image formed on the surface of the photosensitive drum 1 is transferred onto the transfer material P repeatedly by superimposing image transfer, three or four times for the respective colors to form a full-color image.

However, if the transfer material conveying belt 5 receives a high potential by the attraction charging step, not only the difference $V2-V1$, but also a difference $(V3-V'2)$ between the potential V'2 prior to the execution of the second transfer process and a potential V3 after the execution of the second image transfer process, a difference $(V4-V'3)$ between a potential V'3 prior to the execution of the third transfer process and a potential V4 after the execution of the third transfer process and a difference $(V5-V'4)$ between the potential V'4 prior to the execution of the fourth transfer process and the potential V5 after the execution of the fourth transfer process are all smaller than 0.5 KV. Therefore, the above-described improper image transfer occurs in the multi-color electrophotographic copying machine.

SUMMARY OF THE INVENTION

Accordingly, it is a principal object of the present invention to provide an image forming apparatus wherein the transfer material can be attracted by the transfer material carrying means in good order irrespective of the variation in the humidity in the ambience under which the image forming apparatus is placed, and the image can be properly transferred.

It is another object of the present invention to provide an image forming apparatus including good electrostatic attraction means, so that plural images can be transferred onto the same transfer material with good registration.

According to an aspect of the present invention, there is provided an image forming apparatus including a movable image bearing member, means for forming an image on said image bearing member, transfer material carrying means for carrying a transfer material to a transfer station where the image formed on the image bearing member is transferred onto the transfer material, means for electrostatically attracting the transfer material onto the transfer material carrying means prior to an image transfer operation in the transfer station, means for detecting humidity in said image forming apparatus and means for controlling output of said attracting means in accordance with an output of said detecting means.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 10 shows a table stored in a memory shown in FIG. 8.

FIG. 12 shows a table having data different from that of FIG. 10 stored in the memory of FIG. 8.

FIG. 16 shows a table contained in the memory shown in FIG. 14.

DETAILED DESCRIPTION OF THE PREFERRED EMBODIMENTS

The preferred embodiments will be described in conjunction with the accompanying drawings.

Figure 1:
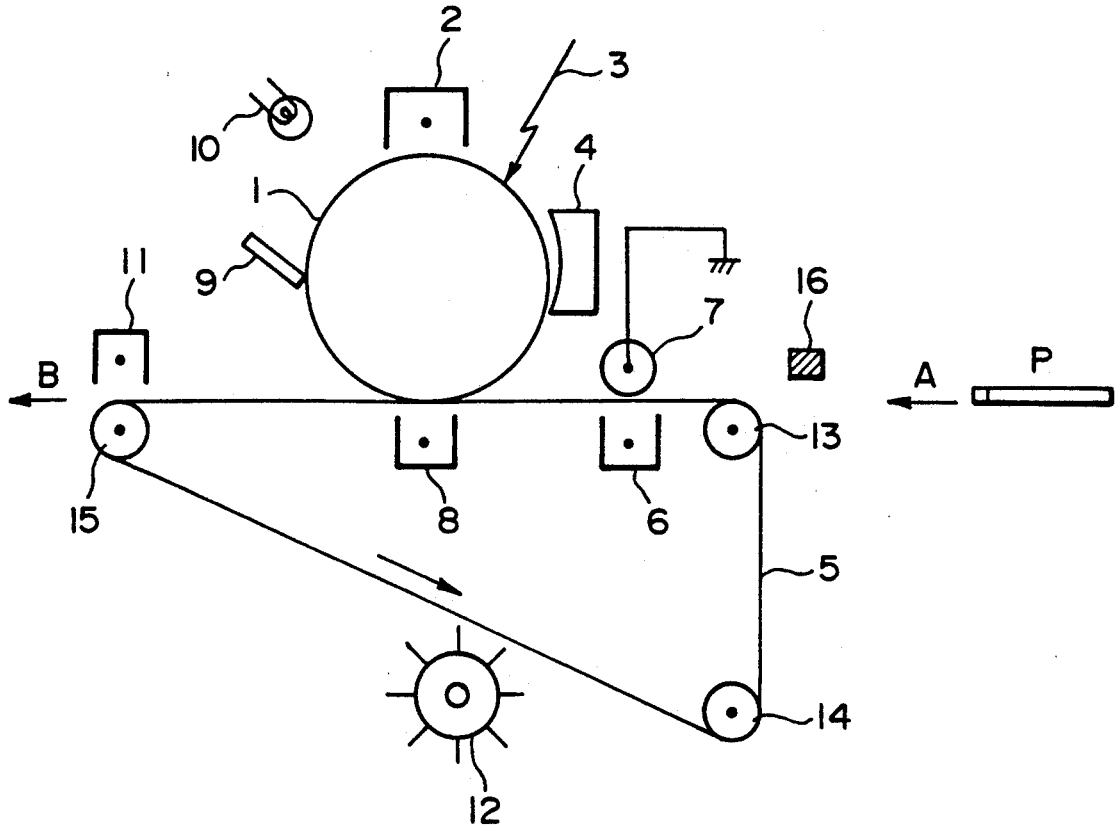
FIG. 1 is a sectional view of an image forming apparatus according to a first embodiment of the present invention.
Figure 19:
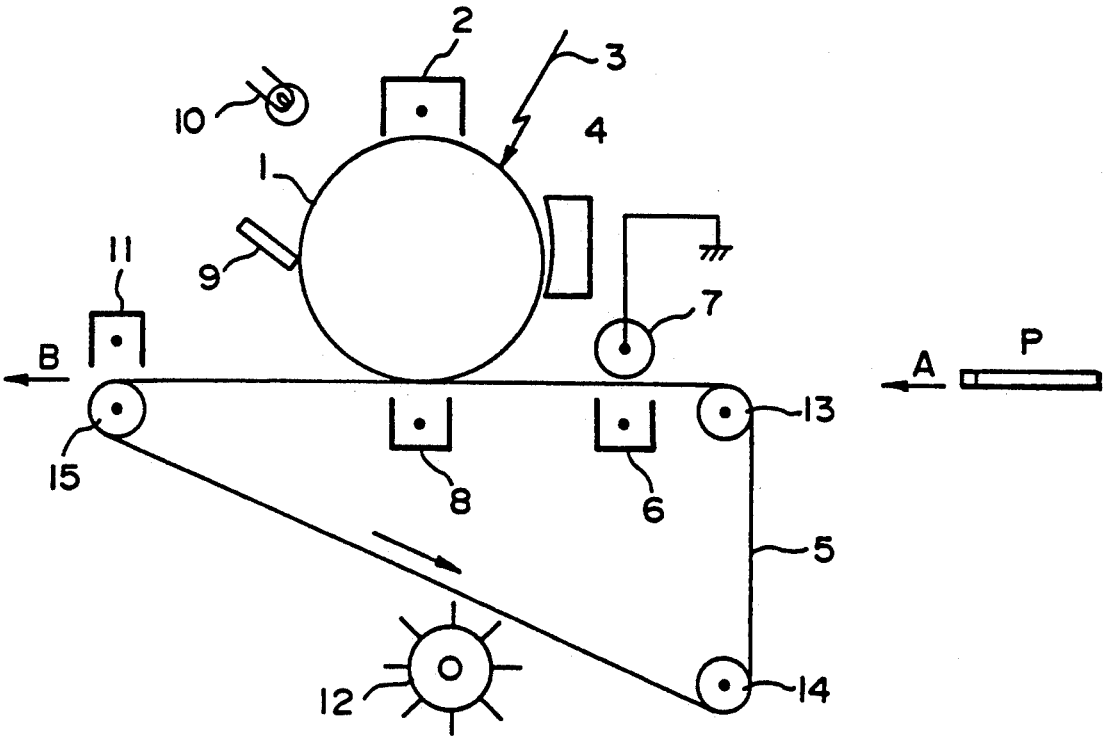
FIG. 19 PRIOR ART
FIG. 19 shows an example of a conventional image forming apparatus.

FIG. 1 shows an image forming apparatus according to a first embodiment of the present invention. The general structure of the image forming apparatus of the first embodiment is similar to the image forming apparatus shown in FIG. 19. The image forming apparatus is provided with a transfer material conveying belt as a transfer material carrying means. Around an image bearing member, that is, a photosensitive drum 1, there are disposed a cleaner 9, a pre-exposure lamp 10, a primary charger 2, a developing device 4 a transfer charging means, that is, a transfer charger 8 and a transfer material conveying belt 5 stretched around metal rollers 13, 14 and 15, as major components. The description of the apparatus will be made in further detail. The primary charger 2 and the developing device 4 define a clearance therebetween through which image exposure light 3 is projected onto the outer peripheral surface of the photosensitive drum 1 by an unshown image exposure means. The transfer material conveying belt 5 is stretched around the metal rollers 13, 14 and 15 in the form of a triangle. The metal rollers 13, 14 and 15 are electrically grounded. The transfer material conveying belt 5 is rotated in the direction indicated by an arrow in FIG. 1 (that is, the counterclockwise direction) by a driving motor (not shown) operatively coupled with the metal roller 15. Around the transfer material conveying belt 5, there is disposed attraction charging means, that is, an attraction charger 6 for attracting the transfer material P (image receiving material) onto the transfer material conveying belt 5, an opposing roller 7, a charge removing discharger 11 and a fur brush cleaner 12 and others.

In this embodiment, the attraction charger 6 has a width of opening of 22 mm, and is disposed such that the distance between the discharging wire thereof and the transfer material conveying belt 5 is 11 mm. The transfer material conveying belt 5 is made of PVdF (polyvinylidene fluoride) having a thickness of 150 microns. It is rotated at a peripheral speed of 160 mm/sec. The opposing roller 7 is made of aluminum and has a diameter of 20 mm. It is electrically grounded and is rotatable following the transfer material conveying belt 5. According to this embodiment, in order to detect the temperature and humidity of the ambience in the color image forming apparatus, a temperature and humidity detecting means, that is, a temperature and humidity sensor 16 is provided. The temperature and humidity sensor 16 is disposed adjacent to the transfer material conveying belt 5 without interference with the moving transfer material P. The temperature and humidity sensor 16 produces a voltage output in accordance with the temperature and humidity in the apparatus detected. The image forming operation of the color image forming apparatus is the same as with FIG. 19 apparatus, and therefore, the detailed description is omitted for simplicity.

Figure 2:
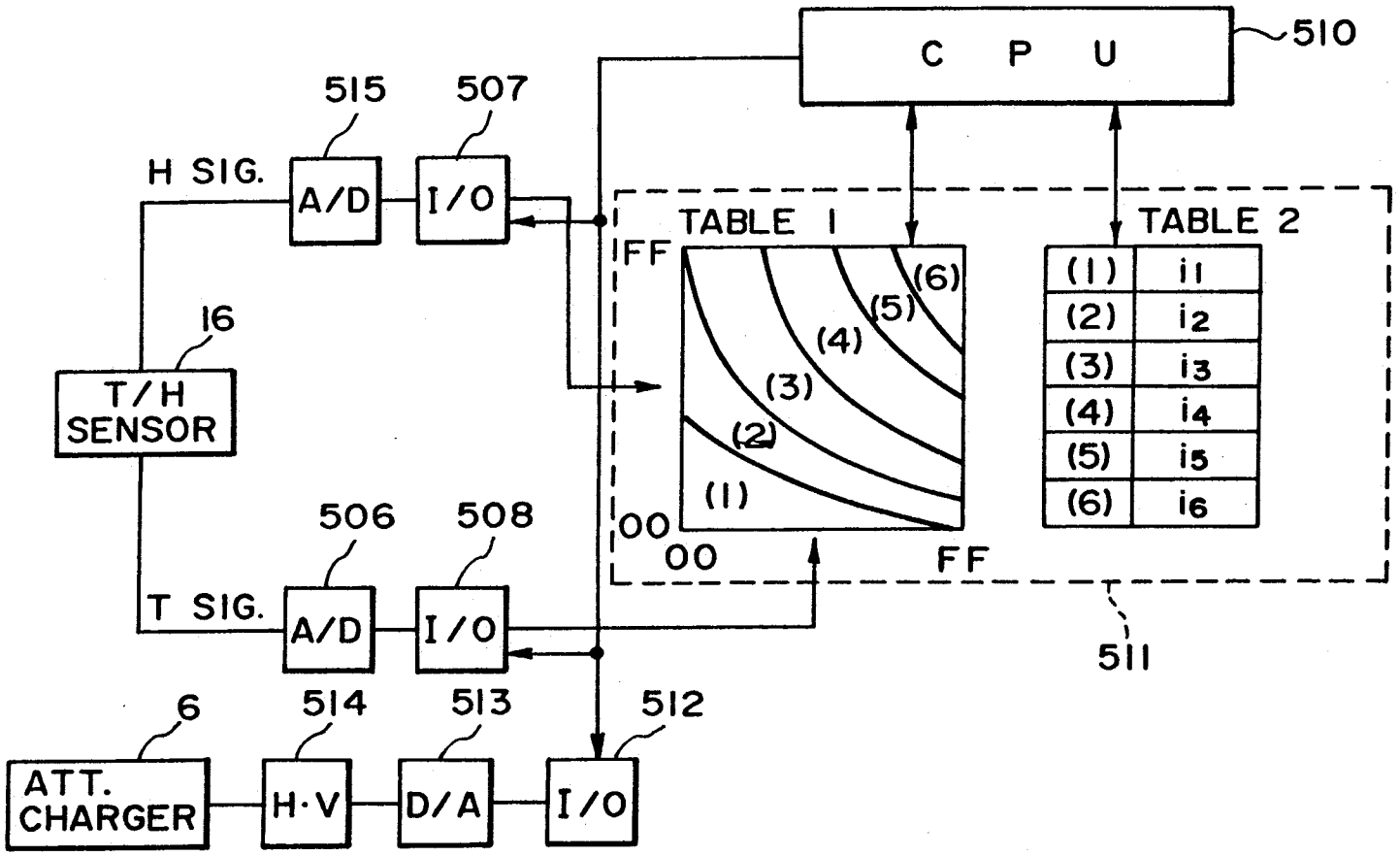
FIG. 2 is a block diagram illustrating a control system in the image forming apparatus in accordance with the first embodiment.

FIG. 2 shows a control system of the image forming apparatus according to the first embodiment. In FIG. 2 the temperature and humidity sensor 16 produces a temperature signal which will be hereinafter be called "T signal" and a humidity detection signal which will hereinafter be called "H signal". An A/D converter 506 converts the analog T signal to a digital signal and supplies it to I/O port 508, and an A/D converter 515 converts the H signal to a digital signal and supplies its to an I/O port 507. A variable adjusting means, that is, a CPU 510 leads the signals supplied to the I/O ports 507 and 508 prior to the series of image forming operations of the image forming apparatus. It refers to table 1 (FIG. 3) stored in a memory 511 and discriminates what region of the regions (1)-(6) of the table 1 the signals fall. On the basis of the discrimination, the CPU 510 refers to a table 2 (FIG. 4) stored in the memory 511, and reads from the table 2 attraction current level data corresponding to the T signal and H signal. Then, it produces the attraction current level data through the I/O port 512 to a D/A converter 513. The D/A converter 513 receives the attraction current level data produced from the CPU 510 through the I/O port 512 and converts it to an analog signal, which in turn is supplied to a high voltage power source 514. Then, the high voltage power source 514 supplies to the attraction charger 6 an attraction current on the basis of the attraction current level data. The series of processing by the CPU 510 is executed prior to the image forming, that is, the copying operation.

Referring to FIGS. 3, 4, 5 and 6, the description will be made in further detail.

Figures 3, 4:
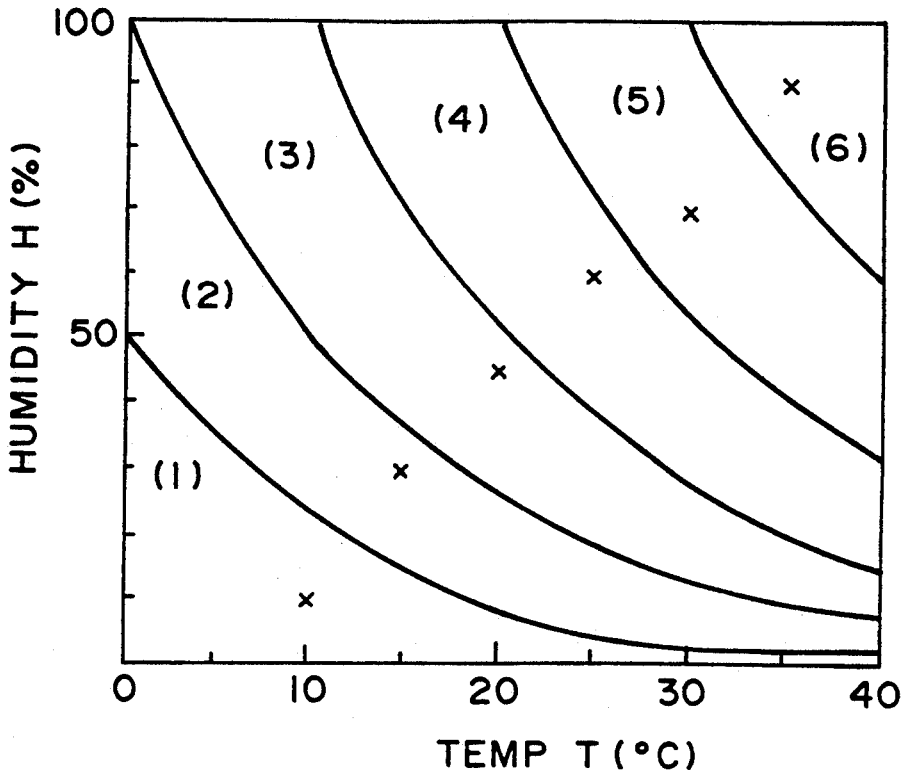
FIG. 3 shows contents of a table stored in a memory show in FIG. 2.
FIG. 4 shows another table stored also in the memory shown in FIG. 2.

FIG. 3 shows the content of table 1 stored in the memory 511 shown in FIG. 2. In the table 1, there are regions (1)-(6) divided and defined by plural constant moisture amount lines determined on the basis of the temperature and the humidity. It is reasonably deemed that in the same region, the charging property of the developer, the charging property of the transfer material P, and the moisture absorbing and charging properties of the transfer material carrying sheet (the transfer material conveying belt 5) are substantially the same, in other words, the ambience is substantially the same.

The data shown in FIG. 4 are the content of the table 2 stored in the memory 511. In the table 2, optimum attraction current levels at representative points in the regions (1)-(6) on the basis of the temperature and humidity of the ambience where the image forming apparatus is placed are contained correspondingly to the regions. The representative regions are indicated by "x" in FIG. 3. The proper attraction current levels for the regions (1)-(6) shown in FIG. 4 are determined through the following process. First, a representative point ("x" in FIG. 3) in each of the regions (1)-(6) in FIG. 3 is determined. Then, under the ambience represented by "x", a relationship is measured between the attraction current level and the attraction force between the transfer material P (80 g paper) and the transfer material conveying belt 5. The attraction force Fad between the transfer material P and the transfer material conveying belt 5 is determined in this embodiment in the following manner.

Figure 6:
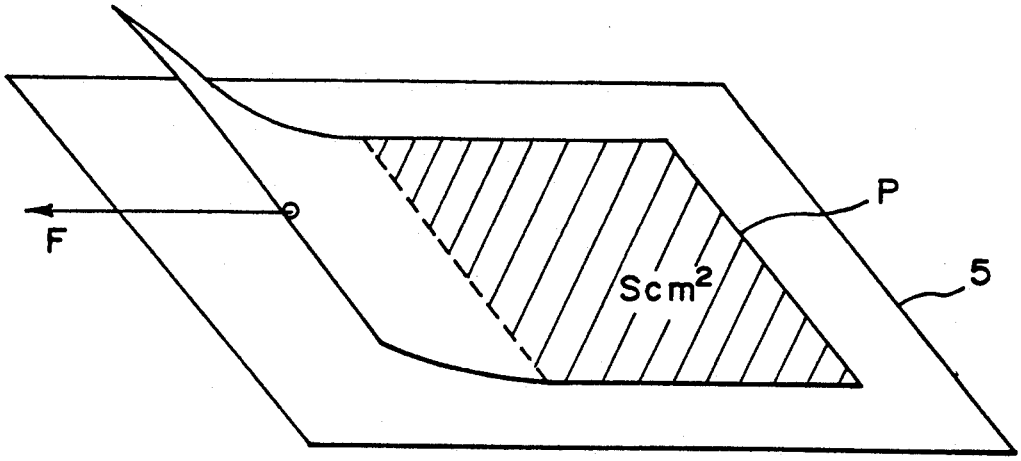
FIG. 6 illustrates measurement method of the attraction force to provide the force Fc shown in FIG. 5.

As shown in FIG. 6, the attraction current Iad is supplied to the attraction charger 6 to attract the transfer material P to the transfer material conveying belt 5, and immediately thereafter, a spring balancer is engaged at a leading edge side of the transfer material with respect to the conveyance direction of the transfer material P, and the transfer material P is pulled along the conveying direction of the transfer material conveying belt by the spring balancer. The critical tension force F (dyne) with which the transfer material P starts to slide on the transfer material conveying belt 5 is measured. Then, the attraction force Fad is determined as the critical tension force F (dyne) divided by a contact area S between the transfer material P and the transfer material conveying belt 5.

Figure 5:
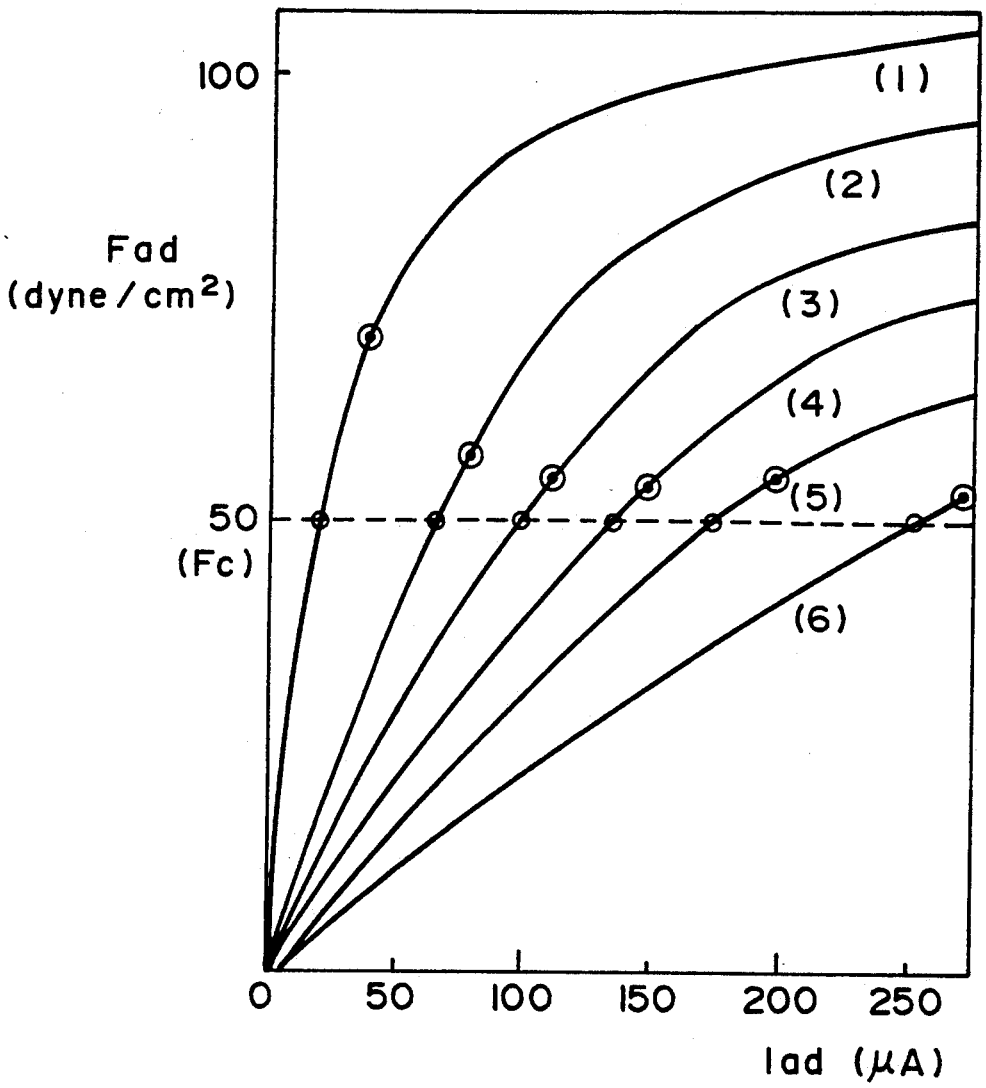
FIG. 5 shows data on the basis of which the table shown in FIG. 4 is determined.

FIG. 5 shows data determined by carrying out the measuring method described above for the respective regions (1)-(6). In FIG. 5, "FC" indicates minimum required attraction force for conveying the transfer material P by the transfer material conveying belt 5. In this embodiment, it is approximately 50 dyne per $cm^2$. The optimum attraction current Iad shown in FIG. 4 is set such that the attraction force Fad which is slightly larger than the attraction force FC shown in FIG. 5, is provided. For the region (1) in FIG. 4, the optimum attraction current is set to be 40 micro-ampere which is slightly higher than the determined optimum level, since this region is within unstable area in which the discharge from the attraction charger easily occurs with the determined attraction current.

As described in the foregoing according to the first embodiment of the present invention, on the basis of the temperature detection signal and the humidity detection signal provided by the temperature and humidity sensor 16, a region is selected form the regions shown in FIG. 3 or the like, and the attraction current supplied to the attraction charger 6 is controlled with the target level equal to the optimum attraction current determined in accordance with the selected region. Therefore, the attraction charger 6 can be supplied with the attraction current which changes in accordance with the change of the volume resistivity of the transfer material P and the change of the surface resistance of the transfer material conveying belt 5 due to the change in the moisture absorption of the transfer material P.

Figure 7:
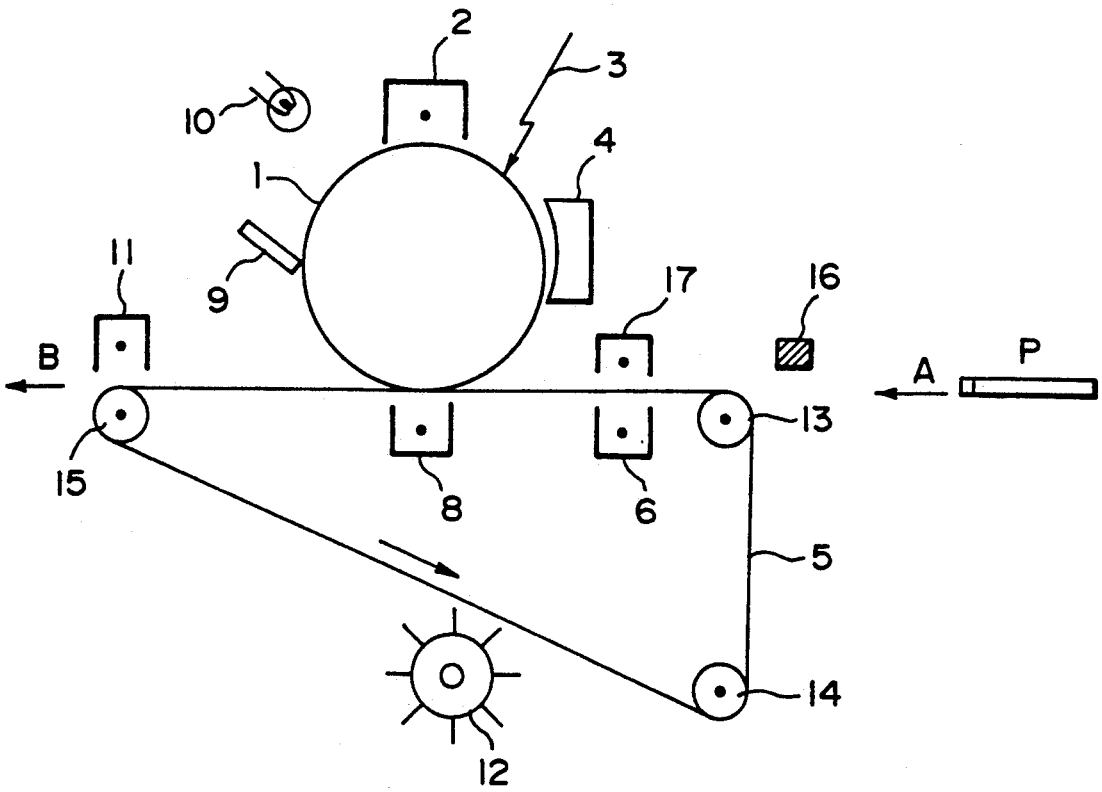
FIG. 7 is a sectional view of an image forming apparatus according to a second embodiment of the present invention.

FIG. 7 shows an image forming apparatus according to a second embodiment of the present invention. In this embodiment, an outside attraction charger 17 (corona charger) is sued in place of the opposing roller 7 shown in FIG. 1. As regards the other structures, they are the same as the image forming apparatus of the first embodiment, and therefore, the detailed description thereof is omitted for simplicity. The outside attraction charger 17 has the same structure as the attraction charger 6. The outside attraction charger 17 has an opening width of 22 mm, and the distance between the discharging wire and the transfer material conveying belt is 11 mm.

Figure 8:
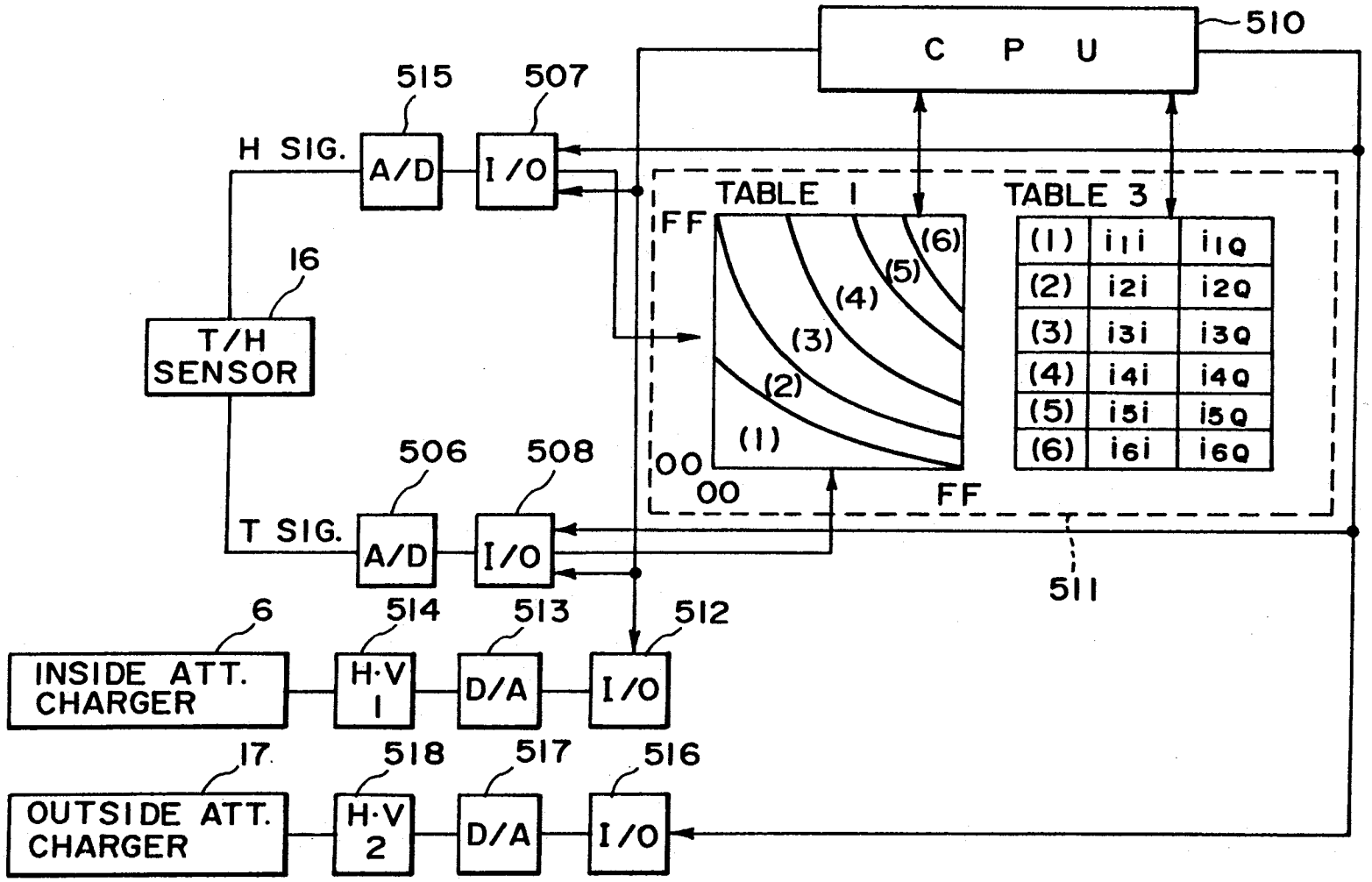
FIG. 8 is a block diagram illustrating a control system of the image forming apparatus according to the second embodiment.

FIG. 8 shows a control system incorporated in the image forming apparatus according to the second embodiment. In this embodiment, the outside attraction charger 17 is used in place of the opposing roller 7, and therefore, the control system in this embodiment contains in addition to the elements contained in the control system of the first embodiment, an I/O port 516 connected with an outside attraction charger 17, a D/A converter 517 and a high voltage electric source 518. The I/O port 516 corresponds to the I/O port 512, and the D/A converter 517 corresponds to the D/A converter 513, and the high voltage source 518 corresponds to the high voltage source 518, and therefore, the detailed description of those elements will be omitted for simplicity. The series of processing operations by the CPU 510 is similar to that in FIG. 1, and therefore, the detailed description thereof is omitted for simplicity.

Memory 511 stores a table 3 in place of the table 2 described in the foregoing. The data contained in the table 3 are related to ambient conditions (regions (1)-(6)) under which the image forming apparatus is placed, an optimum attraction current (Iadi) to be supplied to the inside attraction charger 6 for each of the regions, and an optimum attraction current (Iado) supplied to the outside attraction charger 17 (FIGS. 10 and 12). The inside optimum attraction current and the outside optimum attraction current for each of the regions (1)-(6) shown in FIG. 10 are determined through the following process.

First, representative points in the ambience conditions defined as the regions (1)-(6) of FIG. 3 ("x") are determined, and at each of the representative points, a relationship among the inside attraction current Iadi (Iadsorption inner), an outside attraction current Iado (Iadsorption outer) and the attraction force between the transfer material conveying belt 5 and the attraction force, are measured. Various combinations of the inside attraction current Iadi and the outside attraction current Iado can be considered. The inventors have carried out experiments (1) as to the relation between the currents Iadi and Iado and the attraction force between the transfer material P (8 g paper) and a transfer material conveying belt 5 when Iadi = −Iado, and (2) as to the relation between the current Iadi and the attraction force between the transfer material P (80 g paper) and the transfer material conveying belt 5 when the current Iado = −100 micro-ampere.

Figure 9:
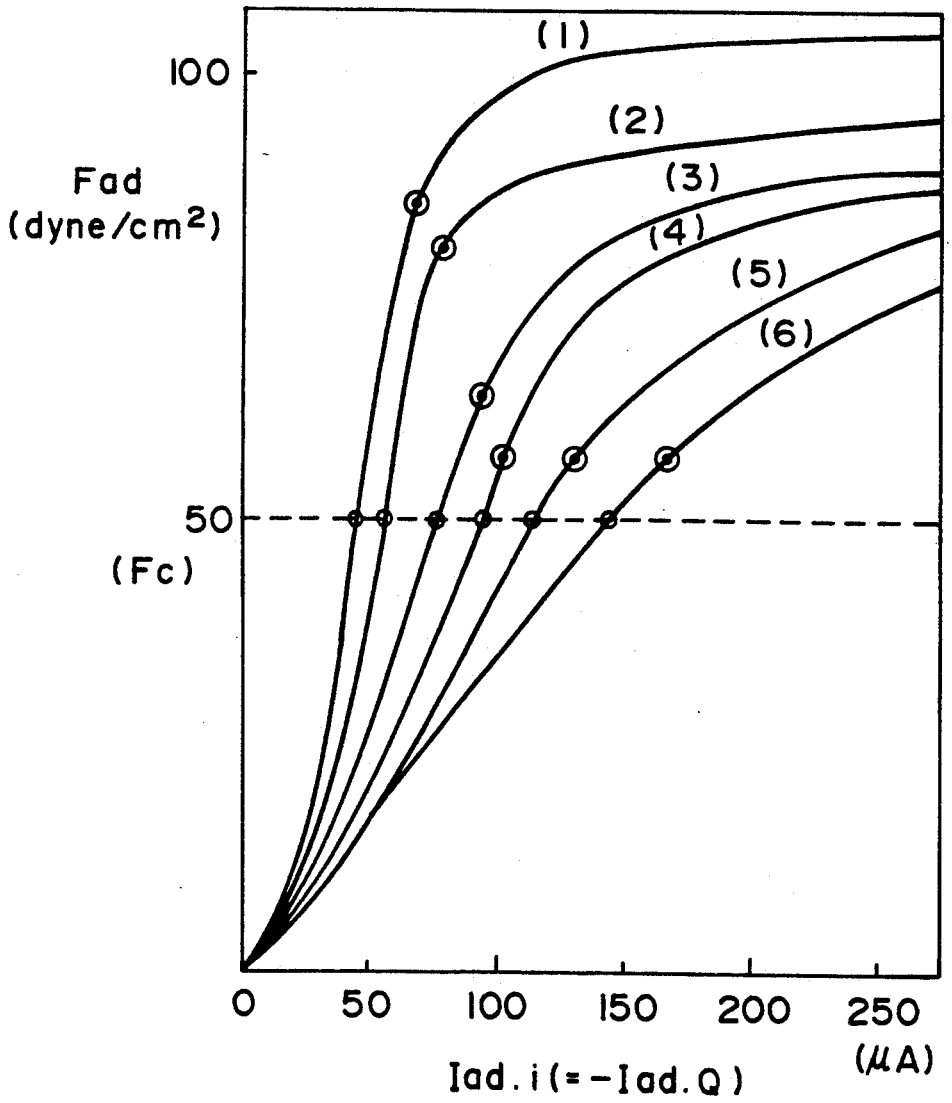
FIG. 9 shows data on the basis of which the data of a table in FIG. 10 is determined.

As a result of the experiment (1), the data shown in FIGS. 9 and 10 were obtained.

FIG. 9 shows the relation between the inside attraction current Iadi and the outside attraction current Iado in the regions (1)-(6) when the inside attraction current Iadi and the outside attraction current −Iado are changed at the same rate.

Figure 11:
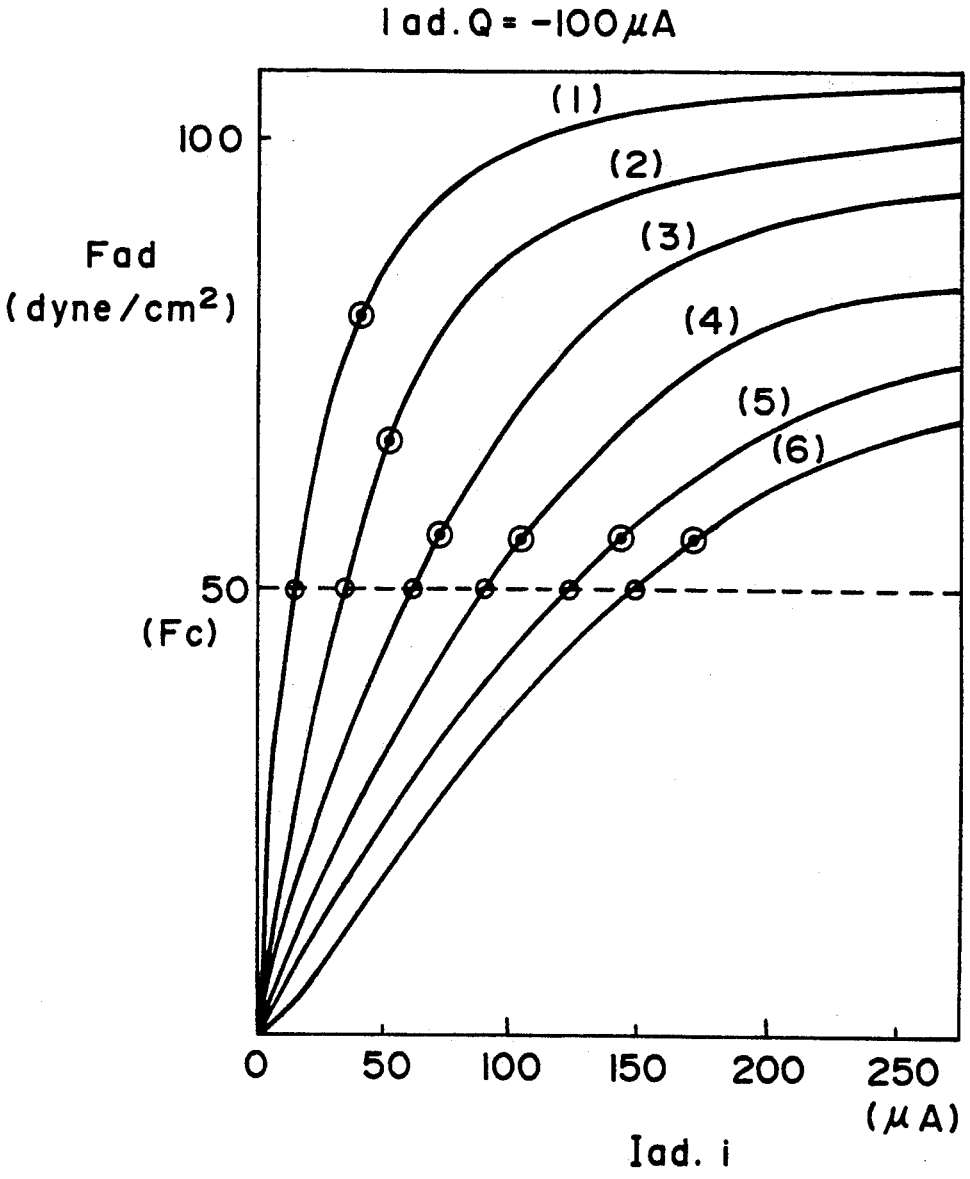
FIG. 11 shows data on the basis of which a table of FIG. 12 is determined and which is different from those shown in FIG. 10.

FIG. 10 shows, as described hereinbefore, the inside optimum attraction current and the outside optimum attraction current are determined on the basis of FIG. 9. The curves determining the regions (1)-(6) shown in FIG. 9 are generally steep, and particularly in the regions (1) and (2), the optimum level are set at the shoulder of the respective curves for stabilization against the steepness of the curves. For this reason, the actual attraction force is quite higher than the force indicated by the point FC indicating the critical attraction force in FIG. 9. As a result of the experiment (1), the data shown in FIGS. 11 and 12 were obtained. FIG. 11 shows the relation between the current Iadi and the attraction force when the current Iado is fixed at −100 micro-ampere. FIG. 12 shows the inside optimum attraction current determined on the basis of FIG. 11. The image forming operation of the image forming apparatus was performed under the conditions determined on the basis of the experiments (1) and (2), and good high quality copy images were provided without improper image transfer or oblique conveyance of the transfer material.

As described in the foregoing, according to the image forming apparatus of the second embodiment, on the basis of the temperature detection signal and the humidity detection signal provided by the temperature and humidity sensor 16, the regions shown in FIG. 3 are defined, and the inside attraction current and the outside attraction current supplied through the inside attraction charger 6 and the outside attraction charger 17, respectively are controlled with the target levels of the inside optimum attraction current and the outside optimum attraction current determined on the basis of a selected one of the regions shown in FIG. 3. Therefore, the inside attraction charger 6 and the outside attraction charger 17 can be supplied with the attraction currents corresponding to the change of the surface resistance of the transfer material conveying belt 5 and the change of the volume resistivity of the transfer material P due to the moisture absorption condition of the transfer material P.

Figure 13:
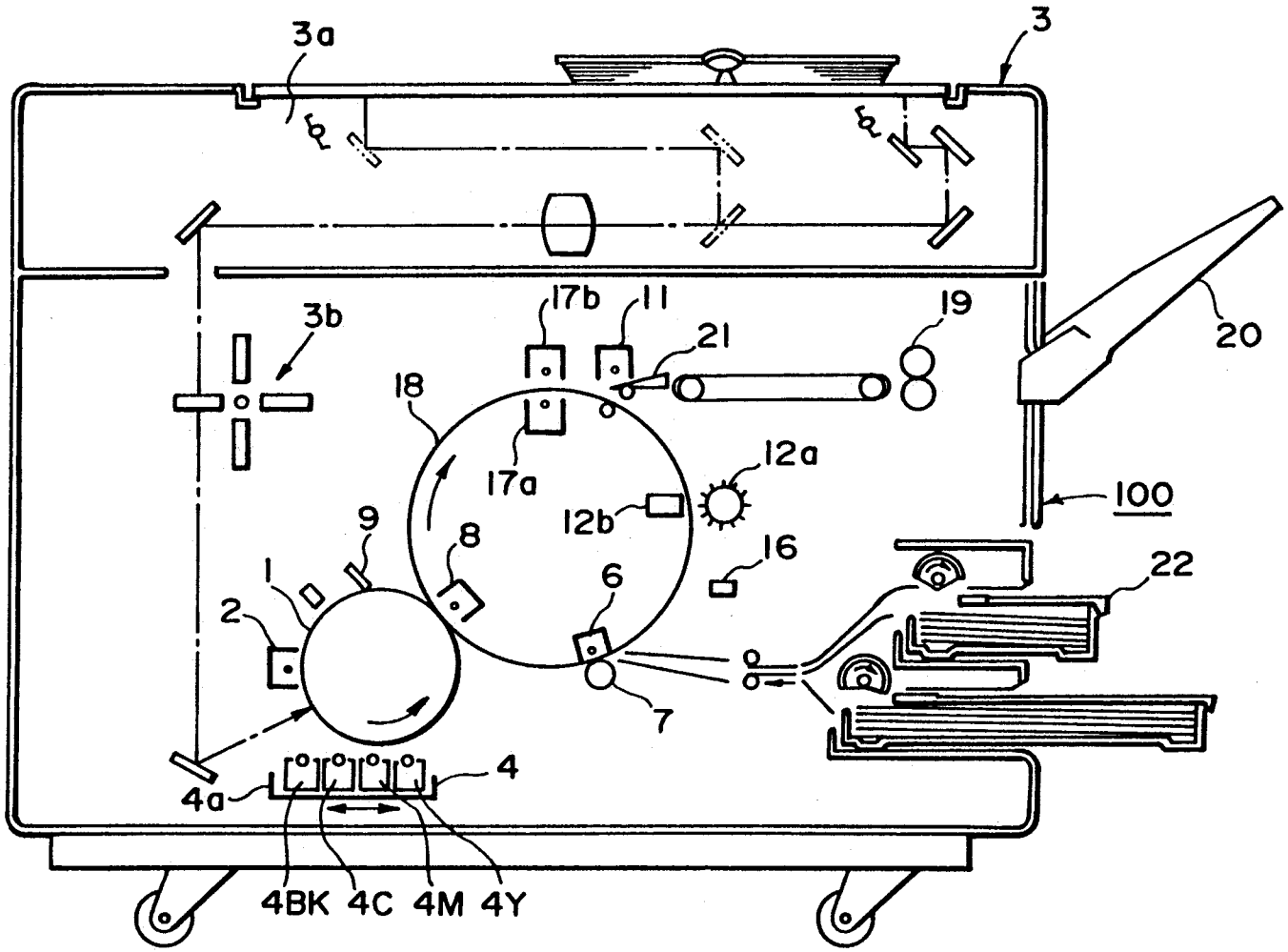
FIG. 13 is a sectional view of a color image forming apparatus according to a third embodiment of the present invention.

FIG. 13 shows a color image forming apparatus according to a third embodiment of the present invention. This color image forming apparatus is provided with a transfer material carrying means in the form of a transfer drum. The general structure thereof is known, and therefore, the description will be made briefly.

As shown in FIG. 13, substantially at the center of the color image forming apparatus 100, there is disposed an image transfer drum 18 having an outer peripheral opening region covered with a transfer sheet made of PVdF sheet having a thickness of 150 microns. The transfer drum 18 is supported for rotation in the direction indicated by an arrow (clockwise direction) within the transfer drum 18, there are disposed an attraction charger 6, a transfer charger 8, a transfer sheet discharger 17*a* and a back-up brush 12*b*. Outside the transfer drum 18, opposite roller 7 is disposed opposed to the attraction charger 6, and in addition, a transfer material discharger 17*b* is disposed opposed to the transfer sheet discharger 17*a*. Adjacent the transfer material discharger 17*b*, a separation discharger 11 and a separation pawl 21 are disposed, and also transfer sheet cleaning brush 12*a* and a temperature and humidity sensor are disposed. At the position where the attraction charger 6 and the opposing roller 7 are opposed, there is an end of a transfer material guiding mechanism for conveying and guiding the transfer material supplied from a sheet supply tray 22 mounted at the right side of the apparatus 100 in FIG. 13. At the portion in the image forming apparatus 100 (upper right portion in FIG. 13) where the separation pawl 21 is provided, there is an image fixing device 19, and between the fixing device 19 and the separating pawl 21, a transfer material conveying belt is disposed. In the upper light portion in the image forming apparatus, an end of the discharge tray 20 is disposed at a position corresponding to the fixing device 19. In the upper region in the image forming apparatus 100, there is an original scanning station 3*a* constituting an optical system 3. In the upper left portion of the apparatus 100 in FIG. 13, there is a color separation filter 3*b* constituting the optical system 3 together with the original scanning station 3*a*.

The original scanning station 3*a* comprises an original illuminating lamp, various reflection mirrors, a lens system, a color image sensor or the like. At substantially the center of the image forming apparatus 100, an image bearing member in the form of a photosensitive drum 1 is disposed which has an outer periphery to which the outer periphery of the transfer drum 18 is contactable. In the bottom region of the apparatus 100, four developing devices which are movable in a horizontal plane adjacent to the outer periphery of the photosensitive drum. The horizontally movable developing devices 4 will be described in detail hereinafter. The photosensitive drum 1 is rotatable in the direction of arrow in FIG. 13 (counterclockwise direction). Around the photosensitive drum 1, various elements required for executing the image formation sequential operation together with the photosensitive drum 1 are disposed. They are the transfer drum 18, the transfer charger 8 and the horizontally movable developing devices which have been described hereinbefore, a cleaner 9, a primary charger 2 and the like. The horizontally movable developing devices 4 will be described. They include a movable member 4*a* movable substantially in a horizontal plane, a yellow developing device 4Y, a magenta developing device 4M, a cyan developing device 4C and black developing device 4BK carried on the movable member 4*a*. The details of the respective elements and the image forming operations are not explained here, because they are known.

Figure 14:
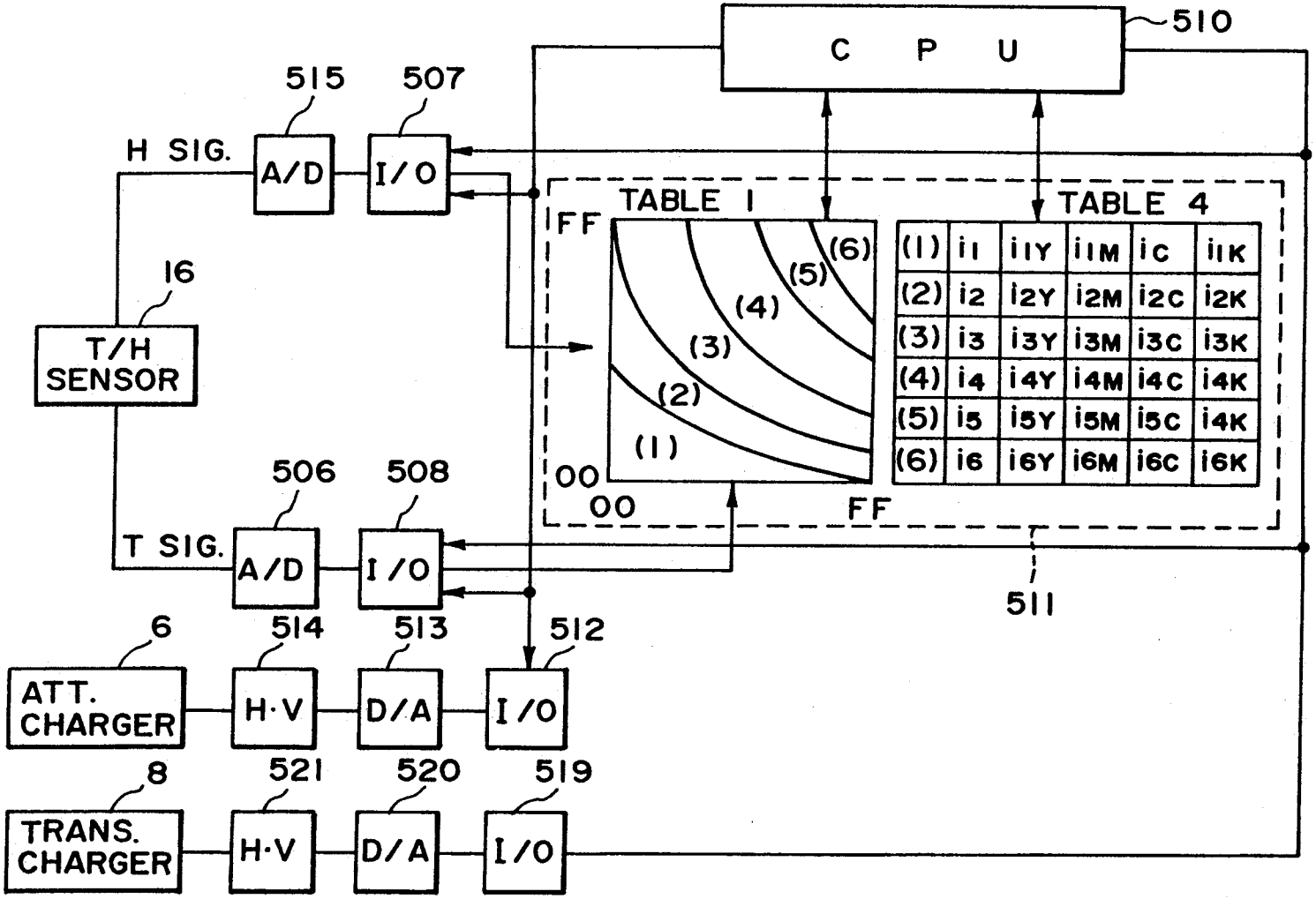
FIG. 14 is a block diagram illustrating a control system contained in the color image forming apparatus in accordance with the third embodiment.

FIG. 14 shows a control system employed in the color image forming apparatus according to the third embodiment of the present invention. In this embodiment, the attraction current supplied to the attraction charger 6 is controlled, and in addition the transfer current supplied to the transfer charger 8 is also controlled. Therefore, the control system in this embodiment includes in addition to the elements explained in conjunction with FIG. 2, an I/O port 519 connected to the transfer charger 8, a D/A converter 520 and a high voltage power source 521. The I/O port 519 corresponds to the I/O port 512; the D/A converter 521 corresponds to the D/A converter 513; and the high voltage source 521 corresponds to the high voltage source 514, and therefore, the detailed description of those elements are omitted for simplicity. The series of operations of the CPU 510 are similar to the first embodiment, and therefore, the description thereof is omitted for simplicity. The memory 511 stores a table 4 in place of the table 2 described hereinbefore. The data in the table 4 contain ambient conditions (regions (1)–(6)) such as temperature and humidity under which the color image forming apparatus is placed shown in FIG. 13, proper attraction currents (Iad) to the attraction charger 6 determined for the respective ambient conditions, and optimum transfer current levels supplied to the transfer charger 8 for the respective image transfer actions of yellow, magenta, cyan and black developed images (FIG. 16).

Figure 15:
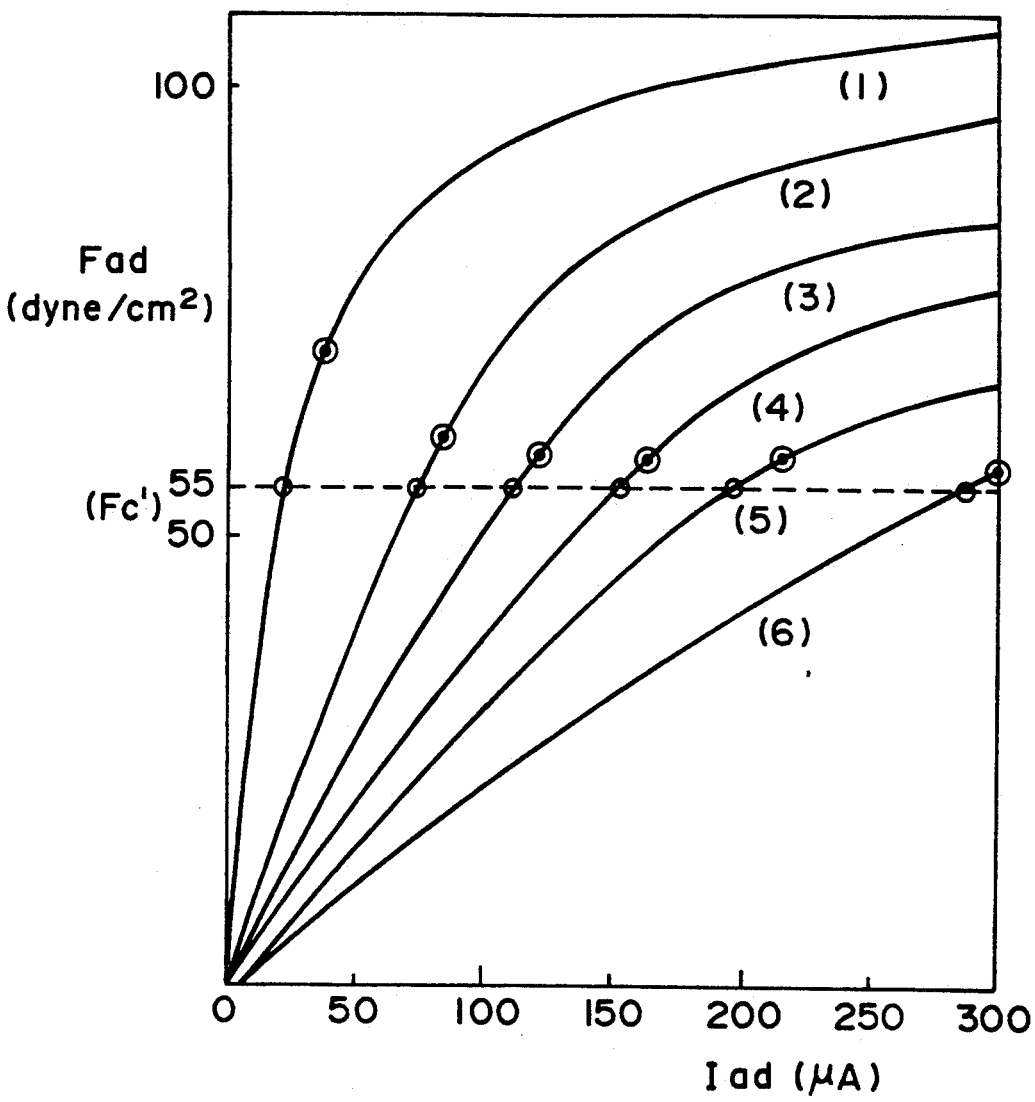
FIG. 15 shows data on the basis of which the proper attraction current data shown in table of FIG. 16 are obtained.

The optimum attraction current and the optimum transfer current for each of the regions (1)–(6) are determined through the following process. First, a representative point ("x" in FIG. 3) is selected for each of the regions (1)–(6) in FIG. 3. Then, the relation is determined between the attraction current Iad and the attraction force between the transfer material P (80 g sheet) and the transfer sheet at each of the representative points. FIGS. 15 and 16 show the data obtained.

In FIG. 15, the point F'C indicates a minimum required attraction force for the transfer sheet stretched over the opening of the transfer drum 18 to carry the transfer material P. In this embodiment, as will be understood from FIG. 15, it is approximately 55 dyne/cm$^2$. The reason why the attraction force F'C is slightly larger than the attraction force FC in the foregoing embodiments is that the transfer drum 18 is employed in this embodiment, and therefore, the influence by the curvature of the transfer material supporting member has to be taken into account. Due to the curvature, the transfer material P tends to separate from the transfer drum or shift thereon due to the rigidity of the transfer material P.

Figure 17:
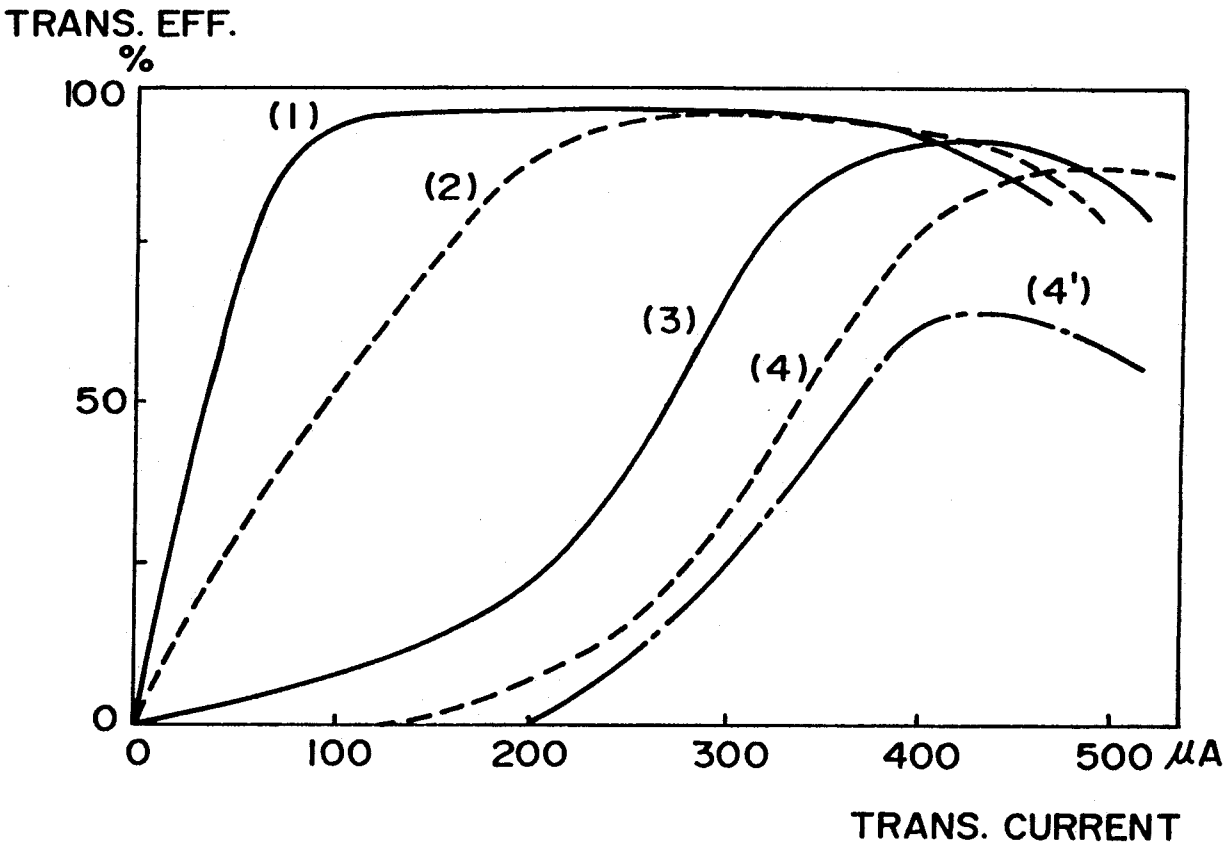
FIG. 17 shows data on the basis of which the proper transfer current data stored in the table of FIG. 16 are obtained.

In the data of FIG. 16, an optimum attraction current level Iad is so selected that the attraction force Fad which is slightly larger than the attraction force FC can be provided. (However, in the region (1) shown in FIGS. 15 and 16, the optimum attraction current Iad providing the attraction force F'C falls within a region in which the discharging operation is not staple, and therefore, the relatively low level 40 micro-ampere is selected in this embodiment although the optimum attraction current is desired to be as high as possible, for example, approximately 70–80 micro-ampere. The reason for this will be described hereinafter.) In this embodiment, as will be understood from FIG. 16, in addition to the optimum attraction current for each of the ambient conditions defined by the regions (1)–(6), an optimum transfer current for the transfer of each of the visualized yellow, magenta, cyan and black images are determined. The optimum transfer current shown in FIG. 16 is determined in the manner shown in FIG. 17. In the graph of FIG. 17, the abscissa represents a transfer current supplied to the transfer charger 8 from the high voltage source 521, and the ordinate represents the transfer efficiency. Here, the transfer efficiency is determined in this manner. An area of 50 mm×50 mm is defined on the outer peripheral surface of the photosensitive drum 1. Latent image forming conditions and developing conditions are determined so as to provide a reflection image density of approximately 1.5, and a visualized image is formed on the photosensitive drum 1. The transfer efficiency is determined on the basis of the weight of the developer by the following:

Transfer efficiency (%)=(weight of the developer on the transfer material)×100/[(weight of the developer on the transfer material)+(weight of the developer on the photosensitive drum after the image transfer)]

In FIG. 17, a curve (1) shows a relation between the transfer current and the transfer efficiency when an image visualized with a yellow developer (first developer) is transferred onto the transfer material P under the condition that the transfer material P is attracted on the transfer sheet with the attraction current Iad of 40 micro-ampere. In the region between 0–100 micro-amperes, the transfer current is so small that the transfer is not sufficient, whereas in the region between 120–320 micro-ampere, the transfer current is so sufficient for the good image transfer. In the region above the 340 micro-ampere, the transfer current is so large that the polarity of the charge of the developer once attracted to the transfer material P from the transfer drum 1 surface is reversed by the transfer charge supplied from the transfer charger 8, and therefore, the developer starts to transfer back from the transfer material P to the photosensitive drum 1 surface. From the characteristic curvature (1), the optimum transfer current (IY) in the region (1) when the first color developer is transferred is set to be 140 micro-ampere.

In FIG. 17, curve (2) shows a relation between the transfer current IM and the transfer efficiency during the image transfer step for a magenta developer (a second color developer) image when the transfer current IY during the first color developer transfer operation is 140 micro-ampere under the condition that the attraction current Iad is 40 micro-ampere. The characteristic curve (2) shows the relation between the transfer current IM and the transfer efficiency as a result of the operation in which during execution of the image formation sequence under the region (1), the attraction current is set to 40 micro-ampere, and the transfer current for the first color is set to 140 micro-ampere, and thereafter, the second color transfer current IM is applied to the transfer charger 8. From the characteristic curve (2), the optimum transfer current (Im) in the region (1) during the transfer operation for the second color developer is set to 240 micro-ampere.

In FIG. 17, a curve (3) shows the relation between the transfer current Ic and the transfer efficiency during the image transfer process for a cyan developer (a third developer) image when the transfer current Iy in the first color developer image transfer is 140 micro-ampere, and the transfer current Im during the second color developer image transfer is 240 micro-ampere under the condition that the attraction current Iad is 40 micro-ampere in the region (1).

In FIG. 17, a curve (4) shows the relation between a transfer current Ibk and the transfer efficiency during the transfer process of a black developer (fourth developer) image when the transfer current Iy during the first color developer image transfer operation is 140 micro-ampere, and the transfer current Im during the second color developer image transfer operation is 240 micro-ampere, and the transfer current Ic during the third color developer image transfer operation is 340 micro-ampere, under the condition that the attraction current Iad in the region (1) is 40 micro-ampere. The same method as in obtaining the characteristics curves (1) and (2) were used when the characteristic curve (3) and (4) are obtained. From the characteristic curve (3), the optimum transfer current (Ic) during the third color developer transfer operation is set to 340 micro-ampere, and from the characteristic curve (4), the optimum transfer current (Ibk) during the fourth color developer image transfer operation is set to 440 micro-ampere. In the regions (2)–(6), the currents are determined in the similar manner.

In FIG. 17, a curve (4)' shows a relation between a transfer current Ibk relating to the fourth color developer and the transfer efficiency when the same experiments as above are performed under the condition that the attraction current Iad is 70 micro-ampere. As will be understood from curve (4)', the level of the transfer current Ibk has a peak at a position where Ibk is approximately 400 micro-ampere, but the transfer efficiency is as low as 65%. The transferred image provided at this time was not good containing void spots. Generally, the transfer efficiency providing a good high quality image is said to be not less than 75%. Therefore, it is considered that the improper transfer results from too large attraction current which leads to saturation of the charge potential of the transfer sheet in the transfer process of the visualized image formed by the black developer (the fourth developer).

As described hereinbefore, when a so-called superimposing image transfer step, if the increase of the surface potential of the transfer sheet by each of the image transfer steps is not less than 0.5 KV, the good image transfer operation is possible. The inventors have actually operated the color image forming apparatus regarding the region (1) with the optimum attraction current and the optimum transfer current determined for the region (1), and have measured the surface potential of the transfer sheet.

Figure 18:
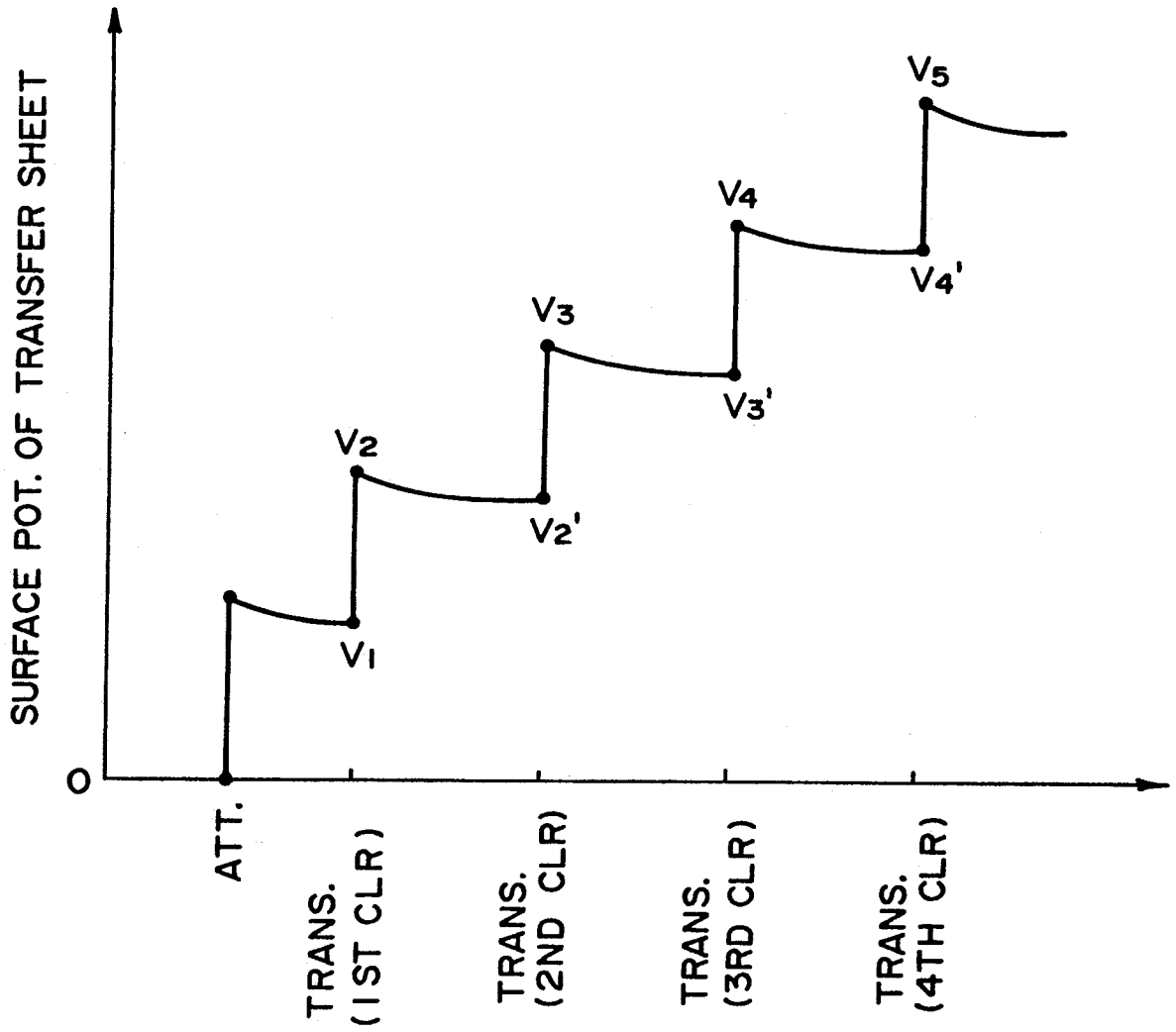
FIG. 18 shows data obtained when the color image forming apparatus according to the third embodiment is operated, and the charge potential of the transfer sheet on the transfer drum is measured along the copy sequential operation.

FIG. 18 shows the results. The voltages (V2−V1), (V3−V'2), (V4−V'3) and (V5−V'4) were approximately 0.6 KV. When the current Iad was 70 microampere, the voltage V5−V'4 was 0.3 KV.

From the series of experimental results described in the foregoing, the data shown in FIG. 16, that is, the table 4 stored in the memory 511 shown in FIG. 14 were obtained.

As described in the foregoing, according to the third embodiment of the present invention, similarly to the first and second embodiments, good and high quality color images can be provided. In this embodiment, for the convenience of explanation, the currents to the attraction charger 6 and the transfer charger 8 are controlled to be constant, but a constant voltage control is possible. As regards the attraction charging, the polarity is determined to be the same as the transfer charging, but it may be opposite. The number of regions ((1)-(6)) may be increased or decreased as desired. As described, according to the foregoing embodiments, the transfer material is always attracted on the transfer material carrying means in good order irrespective of the variation in the ambient conditions under which the image forming apparatus is placed, and in addition, the image transfer operation can be performed properly.

In the foregoing embodiments, a single photosensitive drum is used. Therefore, when toner images are transferred superimposedly onto the same transfer material, the transfer material is passed through the same transfer position a plurality of times. The superimposed image formation on the same transfer material, however, is possible by using plural photosensitive drums.

As regards the method of attracting the transfer material, there is a method wherein charging means are disposed to the opposite sides of the transfer material conveying belt, and the electrostatic force is applied from the belt side and the transfer material side to attract the transfer material onto the belt. The description will be made as to such a case.

Figure 22:
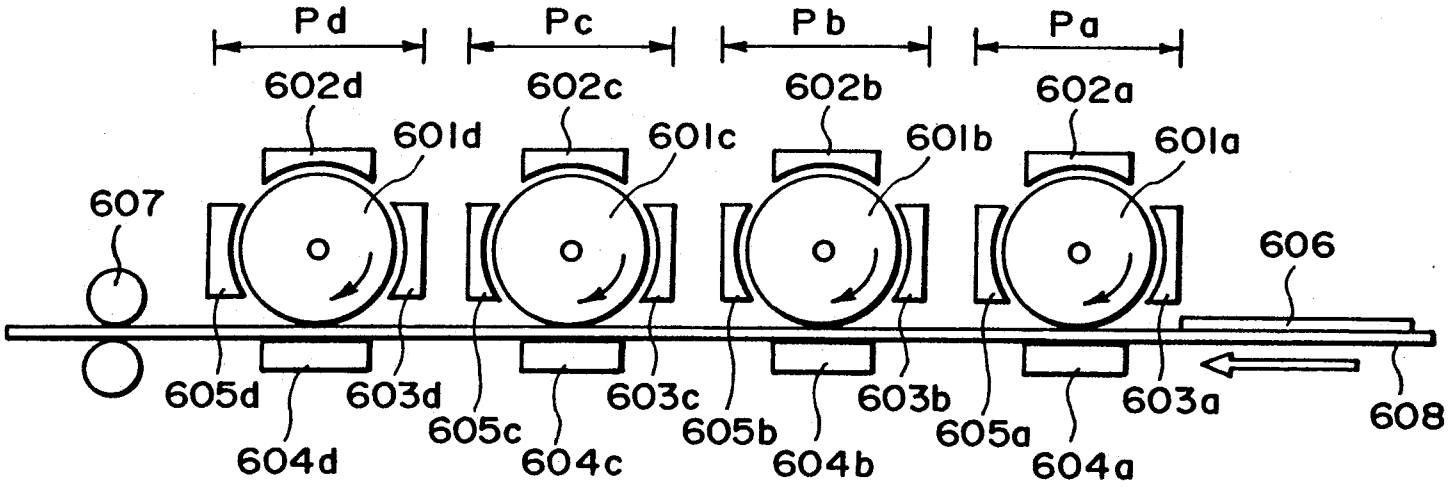
FIG. 22 is a sectional view of a conventional image forming apparatus.

Referring to FIG. 22, there is shown a color image forming apparatus. The apparatus comprises a transfer material conveying belt 608 (conveying means) for conveying transfer material 60, a fixing station 607 and four image forming stations or image formation units Pa, Pb, Pc and Pd juxtaposed along the conveyance direction of the transfer material conveying belt 608. The image formation unit Pa, Pb, Pc and Pd each include a photosensitive drum 601*a*, 601*b*, 601*c* or 601*d*, latent image forming station 602*a*, 602*b*, 602*c* or 602*d*, a developing station 603*a*, 603*b*, 603*c* or 603*d*, a transfer station 604*a*, 604*b*, 604*c* or 604*d* and cleaning means 605*a*, 605*b*, 605*c* or 605*d* around the photosensitive drum 601*a*, 601*b*, 601*c* or 601*d*.

In the structure described above, a latent image of an yellow component of an original image is formed on the photosensitive drum 601*a* through a known electrophotographic process by the latent image forming station 602*a* of the first image formation unit Pa. Thereafter, the latent image is visualized with a developer having yellow toner in the developing station 603*a*, and the yellow toner image thus formed is transferred onto a transfer material 606 in the transfer station 604*a*.

During the yellow image being transferred to the transfer material 606 in the transfer station 604*a*, the second image formation unit Pb produces a latent image by the latent image forming station 602*b* on the photosensitive drum 601*b* for a latent image of a magenta component of the original image. Then, the developing station 603*b* develops the latent image to produce a magenta toner image. The transfer material 606 having received the image from the first image formation unit Pa is introduced into the transfer station 604*b* of the second image formation unit Pb. Then, the magenta toner image is transferred onto the predetermined position on the transfer material 606.

In the same manner, the cyan color image and the black color images are formed in the similar manner, and are transferred onto the transfer material 606 to provide four color superposed toner image is formed. The transfer material 606 is conveyed to an image fixing station 607 where it is subjected to an image fixing operation, whereby the multi-color or full-color image is fixed on the transfer material 606. After the image transfer operations, the respective photosensitive drums 601*a*, 601*b*, 601*c* and 601*d* are subjected to the cleaning operations by the cleaning means 605*a*, 605*b*, 605*c* and 605*d*, respectively so that the respective residual toners are removed to be prepared for the subsequent latent image forming operations.

It has been proposed that as the material constituting the transfer material conveying belt 608, a thin dielectric material sheet made of polyethylene terephthalate resin or polyimide resin is used. The material proposed has a high tension elasticity and high transmission efficiency of the speed control of the transfer material conveying belt 608, and the volume resistivity is generally as high as $10^{16}$ ohm.cm, and therefore, it is preferable for attracting the transfer material 606 on the transfer material conveying belt 608. However, when the belt of such a material is used for the transfer material conveying belt 608 of the color image forming apparatus, plural image transfer operations are carried out for one image forming process, and the transfer material conveying belt 608 is electrically charged each time the image transfer process is executed. Therefore, the uniform image transfer can not be maintained unless the transfer current is sequentially increased with the repetition of the transfer process. Therefore, before completion of one image formation process, it is preferable that the residual electric charge on the transfer material conveying belt 608 is removed by some means such as a discharging brush or an AC discharger down to a predetermined low potential level. If the discharging brush which is advantageous from the standpoint of cost is used, non-uniform discharge tends to occur, and the portions of the transfer material conveying belt 608 which are not sufficiently discharged result in improper image transfer in the transfer process in the next image formation. On the other hand, if the AC discharger is used, the attraction charging has to be performed after the discharging with the result of wasteful consumption of power, although the above-describe non-uniform discharging can be eliminated.

In order to solve the problems, a system wherein the belt discharging and the electrostatic attractions are accomplished at once has been developed. In the color image forming apparatus of this type, prior to the execution of the image transfer process, AC discharging operations are effected simultaneously to the transfer material conveying belt 608 and the transfer material 606, by which the conveying belt 608 and the transfer material 606 are uniformly discharged, and simultaneously, the transfer material 606 is attracted to the transfer material conveying belt 608. By this system, the cost of the apparatus is reduced, and the space in the apparatus can be efficiency used.

However, even when the above-described system is used, there is a problem. The attraction force between the transfer material conveying belt 608 and the transfer material 606 varies significantly in accordance with the ambient conditions under which the apparatus is placed, particularly the humidity of the ambience, even to such an extent that it becomes difficult to separate the transfer material 606 from the transfer material conveying belt 608 after the completion of the superimposed image transfer process.

Figure 21:
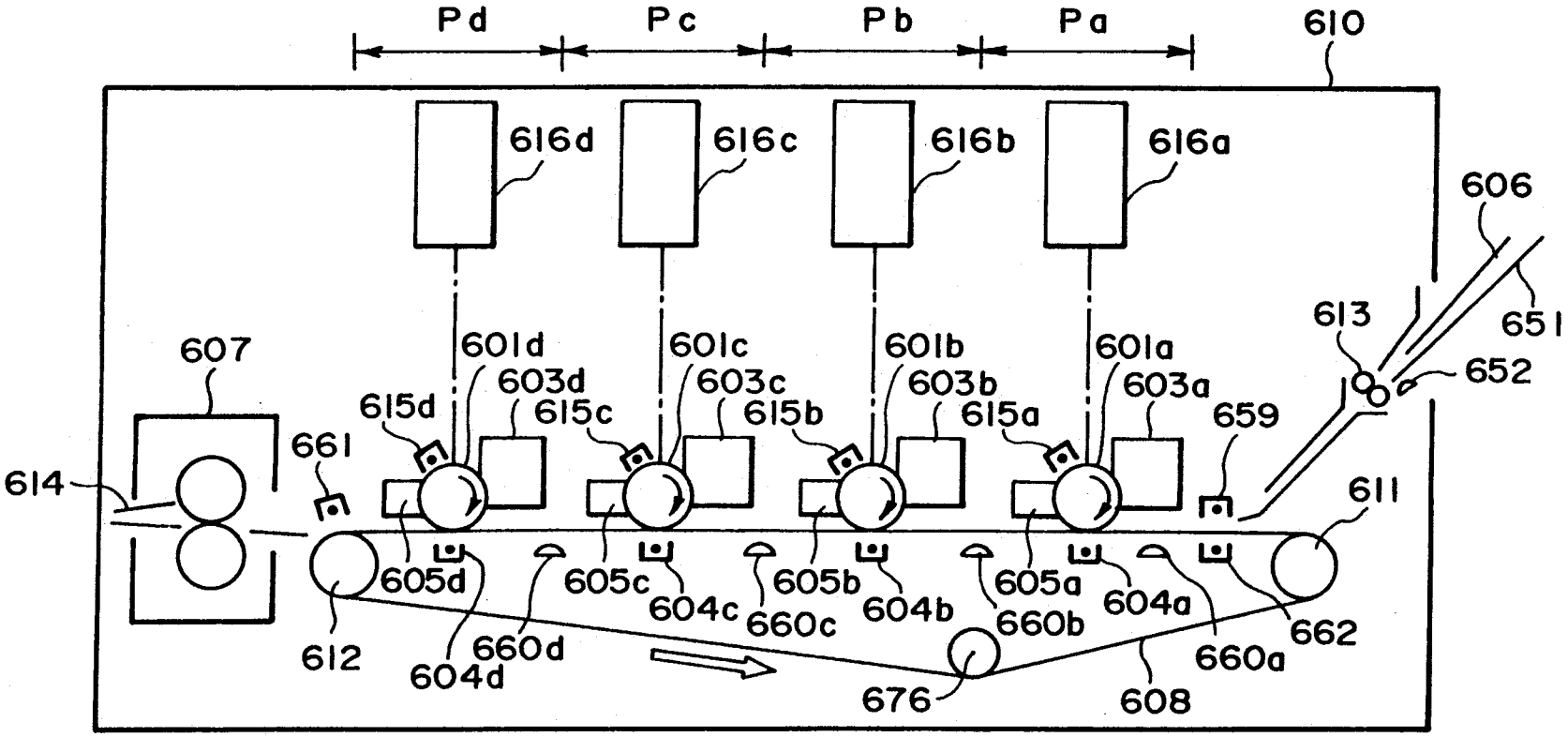
FIG. 21 is a sectional view of a color image forming apparatus according to a further embodiment of the present invention.

Referring to FIG. 21, in consideration of the above, an outlet 614 for the transfer material and an image fixing device 607 is faced to the outlet 614 at the left side of the main body 610 of the image forming apparatus in FIG. 21. On the other hand, at the right side of the main body 610 of the apparatus in FIG. 21, a sheet feeding mechanism 613 is disposed. In the region in the main body 610 from the sheet feeding mechanism 613 to the fixing device 607, the transfer material conveying belt 608 is stretched. The belt 608 is in the form of an endless belt which is stretched between driving roller means, that is, a driving roller 611 disposed adjacent to the sheet feeding mechanism 613 and follower roller means, that is, an idler roller 612 disposed adjacent to the fixing device 607. The tension of the belt is adjustable by an adjusting roller 676. Further, in the region from the driving roller 611 to the idler roller 612, the image formation unit Pa, Pb, Pc and Pd are juxtaposed adjacent to the transfer material conveying belt 608 in the order named from the sheet feeding mechanism 613.

The transfer material conveying belt 608 is driven in the direction of an arrow in FIG. 21 by the driving roller 611 to receive the transfer material 606 fed from a sheet feeding mechanism 613 and to convey it to the image formation units Pa, Pb, Pc and Pd sequentially. In this embodiment, the transfer material conveying belt 608 is made of a material having a small elongation to efficiently transfer the rotation control of the driving roller 611 and having not significant influence to the transfer corona current during the transfer process, such as polyurethane belt having a thickness of 100 microns, a rubber hardness of 97° D and attention elasticity of 16000 kg/cm$^2$, available from Hokushin Kogyo Kabushiki Kaisha, Japan. The sheet feeding mechanism 613 comprises a sheet feeding guide 651 for guiding the transfer material 606 externally supplied, a pair of registration rollers a sensor 6052 for producing an output signal when it detect a leading edge of the transfer material 606 moving in the sheet feeding guide 651. It delivers the transfer material 606 from the driving roller 611 to the transfer material conveying belt 608. The fixing device 607 receives the transfer material 606 from the idler roller 612 side and fixes the visualized image transferred onto the transfer material 606 by the image formation units Pa, Pb, Pc and Pc. The image formation units Pa, Pb, Pc and Pd have substantially the same structure. Each of the image formation units Pa, Pb, Pc and Pd comprises a latent image bearing member in the form of an electrophotographic photosensitive drum 601*a*, 601*b*, 601*c* and 601*d* rotatable in the direction indicated by an arrow, a charger 615*a*, 615*b*, 615*c* or 615*d*, a developing device 603*a*, 603*b*, 603*c* or 603*d*, a transfer discharger 604*a*, 604*b*, 604*c* or 604*d*, cleaning means 605*a*, 605*b*, 605*c* or 605*d* and a laser beam scanner 616*a*, 616*b*, 616*c* or 616*d* which are disposed around the associated one of the photosensitive drums in the order named in the direction of the drum rotation. The developing devices 603*a*, 603*b*, 603*c* and 603*d* contain yellow toner, magenta toner, cyan toner and black toner, respectively.

Each of the laser beam scanners 616*a*, 616*b*, 616*c* and 616*d* comprises a semiconductor laser, a polygonal mirror and an f-$\theta$ lens. It receives electric digital dot signals to produce a laser beam modulated in accordance with the signal to scan the drum surface in the direction of the generating line of the drum at a position between the charger 615*a*, 615*b*, 615*c* or 615*d* and the developing device 603*a*, 603*b*, 603*c* or 603*d* to expose imagewisely each of the drums to the respective laser beam scanners 616*a*, 616*b*, 616*c* and 616*d*, picture element signals corresponding to an yellow component image, a magenta component image, a cyan component image and a black component image are supplied, respectively. In this embodiment, between the image formation unit Pa and the sheet feeding mechanism 613, a first charging means, that is, an attraction charger 659 and a second charging means, that is, an attraction charger 662 are disposed with the transfer material conveying belt 608 therebetween. The attraction chargers 659 and 662 effect corona discharge in order to assuredly attract the transfer material 606 supplied from the sheet feeding mechanism 613 to the transfer material conveying belt 608. The attraction charger 659 and the attraction charger 662 will be described further hereinafter. A discharger 661 is disposed between the image formation unit Pd and the fixing device 607 substantially right above the idler roller 612. To the discharger 661, an AC voltage is applied to separate the transfer material 606 from the conveying belt 608.

Upstream of each of the image formation units Pa, Pb, Pc and Pd, there is disposed a sensor 660*a*, 660*b*, 660*c* or 660*d*. Each of the sensors 660*a*, 660*b*, 660*c* and 660*d* detects a leading edge of the transfer material 606 conveyed by the transfer material conveying belt 608 to supply to an electronic circuit control means, that is, a control unit not shown a signal for starting the image forming process in each of the image formation units Pa, Pb, Pc and Pd.

When the transfer material 606 in the form of a cut sheet is inserted on the sheet feed guide 651 of the sheet feeding mechanism 613, the leading edge thereof is detected by the sensor 652, in response to which a start signal is produced by the sensor 652 to start rotations of the photosensitive drum 601*a*, 601*b*, 601*c* and 601*d* of the image formation units Pa, Pb, Pc and Pd. The driving roller 611 is simultaneously driven, so that the transfer material conveying belt 608 starts to rotate in the detection indicated by an arrow.

When the transfer material 606 is guided along the sheet feed guide 651 and is placed on the transfer material conveying belt 608, it is subjected to the corona discharge from the attraction charger 659 and is assuredly attracted on the transfer material conveying belt 608. When the transfer material conveying belt 608 moves in the direction indicated by an arrow in FIG. 21, the leading edge of the transfer material 606 is detected by each of the sensors 660*a*, 660*b*, 660*c* and 660*d*, in response to which each of the image forming operations on the photosensitive drum 601*a*, 601*b*, 601*c* and 601*d* are started, sequentially. More particularly, the first image formation unit Pa forms an yellow image on the photosensitive drum 601*a*; the second image formation unit Pb forms a magenta image; the third image formation unit Pc forms a cyan image; and the fourth image formation unit Pd forms a black image. The image formation process in each of the image formation units Pa, Pb, Pc and Pd is Carlson process which is well-known, and therefore, the detailed description is omitted for simplicity.

By the movement of the transfer material conveying belt 608, the transfer material 606 is conveyed toward the fixing device 607 through the portions below the photosensitive drums 601a–601d of the first, second, third and fourth image formation units Pa–Pd, during which the transfer discharger 604a, 604b, 604c and 604d sequentially transfer the respective color images on the same transfer material 606 to provide a combined color image. After the transfer material 60 passes through the fourth image formation unit Pd, the transfer material 606 is electrically discharged by the discharger 661 supplied with an AC voltage, and is separated from the transfer material conveying belt 608. The transfer material 606 separated from the transfer material conveying belt 608 is introduced into the fixing device 607, where it is subjected to the image fixing operation. Thereafter, it is discharged outside the apparatus 610 through the outlet 614. Thus, one printing cycle terminates.

In this embodiment, the polarity of the high voltage applied to the attraction charger 662 is the same as the high voltage applied to the transfer discharger 604a, 604b, 604c and 604d. The polarity of the high voltage applied to the attraction charger 662 is the opposite to the charger 659.

Figure 20:
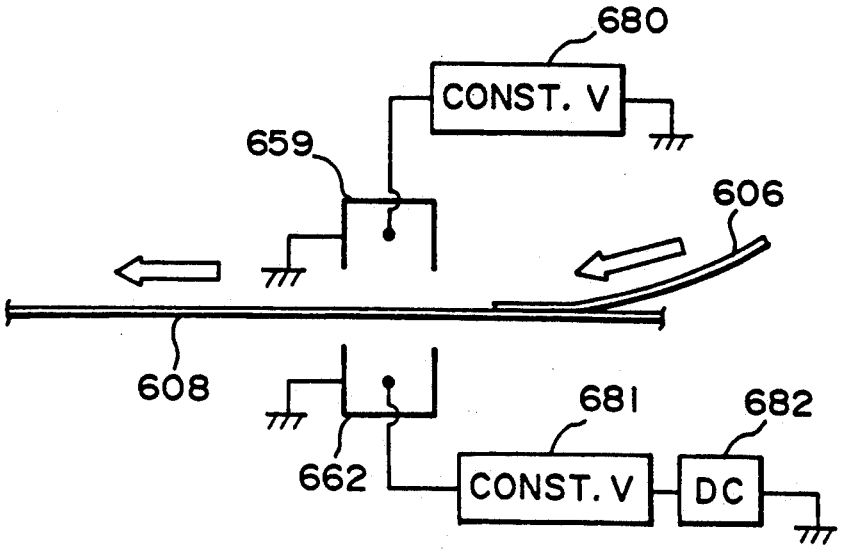
FIG. 20 is a sectional view of a color image forming apparatus according to another embodiment of the present invention.

In this embodiment, the distance between the attraction discharging wire of each of the attraction chargers 659 and 662 and the transfer material conveying belt 608 is 15 mm, and the distance between the attraction discharging wire and the backing electrode plate of each of the attraction chargers is 8.5 mm. The total amount of the current supplied to the attraction charger 659 is 500 micro-ampere, and that of the attraction charger 662 is 300 micro-ampere. Referring to FIG. 20, the attraction charger 659 is connected with a constant voltage AC source 680 only, so that it is supplied only with an AC voltage. On the other hand, the attraction charger 662 is connected with a high constant voltage AC source 681 connected in series with a DC source 682 so that it is supplied with a DC biased AC voltage. At a proper position in the apparatus 610, a humidity sensor (known type, not shown) is disposed. The humidity sensor will be explained hereinafter. The power supply system will be described in further detail. The high constant voltage AC source 680 and a high constant voltage AC source 681 have the same rating. The DC source 682 functions to add a DC voltage of positive polarity to the AC voltage of the constant voltage AC source 681, and the added voltage is supplied to the attraction charger 662.

In the image forming apparatus described above, copy paper (80 g paper) ordinarily used for the transfer material 606 is used, and the force required for peeling the transfer material 606 from the transfer material conveying belt 608 by measuring the force required for shifting the transfer material 606 electrostatically attracted on the transfer material conveying belt 606 in the horizontal direction in FIG. 20 by a force gauge (spring balance). The following is data under a normal temperature and normal humidity condition (25° C., 60% RH), a high temperature and high humidity condition (30° C., 90% RH) and a low temperature and low humidity condition (10° C., 10% RH).

TABLE 1

| | Present invention | Prior art | Another embodiment of present invention |
|---|---|---|---|
| Normal temp. Normal humid. 25° C., 60% RH | 1100 (g) | 1500 (g) | 1300 (g) |
| High temp. High humid. 30° C., 90% RH | 750 | 400 | 900 |
| Low temp. Low humid. 10° C., 10% RH | 1500 | 2400 | 1700 |

The increase of the attraction force of the transfer material 606 to the transfer material conveying belt 608 under the low humidity condition as shown in the data of Table 1, may give rise to a difficultly in separating the transfer material 606 from the transfer material conveying belt 608 after the superimposing image transfer process is executed to the transfer material 606. Particularly when the used transfer material 606 is thin, 60 g paper for example, the separation becomes more difficult. The difficulty in the separation of the transfer material 606 from the transfer material conveying belt 608 is different depending upon various conditions during the separation such as the curvature of the idler roller 612 (FIG. 21) or a moving speed of the transfer material conveying belt 608. In the experiments by the inventors, the unsatisfactory separation occurs if the attraction force is not less than 200 g, when the rollers 611 and 62 have a diameter of 40 mm, the movement speed of the transfer belt 608 is 85 mm/sec, the discharger 661 is not energized, the relative humidity is 10%, and the transfer material 606 is a copy paper of base weight of 60 g.

On the other hand, the reduction of the attraction force of the transfer material 606 to the transfer material conveying belt under the high humidity condition is remarkable when the used transfer material 606 is thicker, more particularly, not less than 120 g of base weight. In that case, the attraction force is not sufficient with the result that the registrations among the images provided by the image formation units Pa–Pd is disturbed.

In order to solve the problem, the color image forming apparatus according to this embodiment is provided with a humidity sensor (known type) in the main body of the apparatus 610. On the basis of the detection of the relative humidity provided by the humidity sensor, the attraction force between the transfer material 606 and the transfer material conveying belt 608 is controlled. More particularly, in this embodiment, the humidity condition is divided into three ranges, namely not more than 30%, 30%–70% and not less than 70%, on the basis of the regions, the attraction condition on the transfer material 606 to the transfer material conveying belt 608 is changed. For example, when the relative humidity is not more than 30%, the DC voltage applied to the attraction charger 662 is lowered to approximately +1.0 KV from +2.32 KV which is the voltage under the normal condition (the relative humidity of 30–70%). On the other hand, when the relative humidity is not less than 70%, the DC voltage is increased to approximately +4.0 KV. The attraction force of the transfer material 606 to the transfer material conveying belt 608 controlled in the manner described above is shown in the left column in Table 1.

The repeated investigations and experiments by the inventors have revealed that the same effects can be provided by shifting the phase of the AC voltage applied to the attraction charger 569 and the attraction charger 662. More particularly, in the structure shown in FIG. 20, the phase of the AC voltage applied to the attraction charger 659 and the phase of the AC voltage applied to the attraction charger 662 are made different by 180 degree (opposite phase), and the force required for peeling the transfer material has been measured. The data are shown in the right column in Table 1. The data in the right column of Table 1 are, similarly to the described above, when the transfer material 606 has the base weight of 80 g (copy sheet), and under a normal temperature and normal humidity condition (25° C. and 60% RH), under a high temperature and high humidity condition (30° C., 90% RH) and under a low temperature and low humidity condition (10° C., 10% RH). Similarly to the foregoing, under the high humidity and low humidity conditions, respectively, the level of the DC voltage applied to the attraction charger 662 is controlled.

When a comparison is made between the data in the left column of Table 1 with the data in the right column, the attraction force in this control system is generally stronger than the control system described in the foregoing. The attraction condition in this control system is sufficiently usable when the separation between the transfer material 606 and the transfer material conveying belt 608 is made easier by, for example, increasing the curvature of the idler roller 612. Alternatively, in order to provide the attraction force equivalent to the data in the left column, the level of the DC voltage applied to the attraction charger 662 may be generally lowered. It has been confirmed that the transfer material conveying belt 608 is uniformly discharged electrically by the AC voltage applied to the attraction chargers 659 and 662, so that it has a uniform surface potential, by a surface potentiometer, and image data or the like.

As described in the foregoing, according to the embodiments, an image forming apparatus can be provided wherein without increasing the cost and without requiring addition space, the transfer material conveying means can be discharged uniformly, the transfer material can be electrostatically attracted on the transfer material conveying means, and the separation of the transfer material from the transfer material conveying means is easy after the completion of the superimposing transfer process, irrespective of the humidity of the ambience.

The present invention is not limited to the case of color image formation, but is effective to a black monochromatic color transfer device. The attracting means has been described as being a corona discharger, that it may be of another form, if it applies a bias voltage to provide the electrostatic attraction force.

The present invention is not limited to an image forming apparatus requiring the image transfer step, but is applicable to an image forming apparatus in which an image is directly formed on a member receiving the image.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

means for forming an image on said image bearing member;

carrying means for carrying an image receiving material;

transfer means for electrostatically transferring the image from said image bearing member onto the image receiving material carried on said carrying means, said transfer means effecting its image transfer operations on the same image receiving material a plurality of times;

electrostatic attracting means for electrostatically attracting the image receiving material onto said carrying means before the image transfer operation; and control means for controlling an output of said attracting means and an output of said transfer means in accordance with an ambient condition, said control means increasing the output of said transfer means for an initial image transfer on the same image receiving material with an increase of the output of said attracting means.

2. An apparatus according to claim 1, wherein said carrying means includes a dielectric member for carrying the image receiving material which is movable along an endless path.

3. An apparatus according to claim 1, wherein said image transfer by said transfer means is repeated on the same transfer material, and wherein an output of said transfer means is increased with repetition.

4. An apparatus according to claim 1, wherein said apparatus comprises means for detecting temperature and humidity in said apparatus, said control means containing plural ambience regions defined by plural constant moisture amount curve determined on temperature and humidity, and a region is selected in accordance with the temperature and the humidity detected by said detecting means, wherein the output of said attracting means and the output of said transfer means for the initial image transfer are determined in accordance with the region.

5. An apparatus according to claim 1, wherein said attracting means includes corona discharging means facing said carrying means, and said control means control an output of said corona discharging means.

6. An apparatus according to claim 5, wherein said attracting means includes an electrically grounded rotatable member in contact with a side of said carrying means which is remote from said corona discharging means.

7. An apparatus according to claim 1, wherein said apparatus is capable of forming a full-color image on the image receiving material.

8. An apparatus according to claim 1, wherein said control means controls electric current supplied to the attracting means.

9. An apparatus according to claim 1, wherein said attracting means includes an inside attracting means, disposed in said carrying means, having the same charge polarity which is the same as that of said transfer means, and an output of the transfer means increases with increase of an output of the inside attracting means.

10. An apparatus according to claim 1, wherein during passage of the image receiving material between said attracting means and said carrying means, said attracting means is supplied with a DC voltage and a voltage having periodically changing voltage level.

11. An apparatus according to claim 1, wherein said image bearing member includes a photosensitive member.

* * * * *

UNITED STATES PATENT AND TRADEMARK OFFICE

CERTIFICATE OF CORRECTION

PATENT NO. : 5,276,483

DATED : January 4, 1994

INVENTOR(S) : TAKASHI HASEGAWA, ET AL.

It is certified that error appears in the above-indentified patent and that said Letters Patent is hereby corrected as shown below:

On title page, item [56] add the following references:

4,660,077 4/1987 Kawamura, et al.....355/327(x)
4,737,816 4/1988 Inoue, et al.....355/274(x)
4,682,158 7/1987 Ito, et al.....355/209(x)
4,162,843 7/1979 Inoue, et al.....355/274(x)
4,014,605 3/1977 Fletcher.....355/273
4,733,281 3/1988 Yoshinaga, et al.....355/208

Item [56] add the following, "FOREIGN PATENT DOCUMENTS"

0287271 12/1987 Japan
0015776 1/1989 Japan
0015777 1/1989 Japan
0085772 4/1988 Japan
0055675 3/1986 Japan
0082856 5/1982 Japan
0110280 8/1980 Japan
0298505 1/1989 European Patent Office

UNITED STATES PATENT AND TRADEMARK OFFICE

CERTIFICATE OF CORRECTION

PATENT NO. : 5,276,483

DATED : January 4, 1994

INVENTOR(S) : TAKASHI HASEGAWA, ET AL.

It is certified that error appears in the above-indentified patent and that said Letters Patent is hereby corrected as shown below:

On title page, item [57] Abstract,

Line 3, "such an" should read --such as an--.

Column 2

Line 58, "to" should read --too--.

Column 7

Line 49, "sued" should read --used--.

Column 8

Line 49, "level" should read --levels--.

Column 11

Line 9, "staple," should read --stable,--.

Column 13

Line 41, "transfer material 60," should read --transfer material 606,--.

Column 15

Line 26, "unit" should read --units--;

Line 45, "sensor 6052" should read --sensor 652--;

UNITED STATES PATENT AND TRADEMARK OFFICE

CERTIFICATE OF CORRECTION

PATENT NO. : 5,276,483 Page 3 of 3

DATED : January 4, 1994

INVENTOR(S) : Takashi Hasegawa, et al.

It is certified that error appears in the above-indentified patent and that said Letters Patent is hereby corrected as shown below:

Column 15, line 46, "detect" should read --detects--.

Signed and Sealed this

Sixteenth Day of August, 1994

*Attest:*

BRUCE LEHMAN

*Attesting Officer*

*Commissioner of Patents and Trademarks*